US011198211B2

(12) United States Patent
Umino et al.

(10) Patent No.: US 11,198,211 B2
(45) Date of Patent: Dec. 14, 2021

(54) DRIVER

(71) Applicant: Koki Holdings Co., Ltd., Tokyo (JP)

(72) Inventors: Mayumi Umino, Ibaraki (JP); Sotaro Aizawa, Ibaraki (JP); Takashi Ueda, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 305 days.

(21) Appl. No.: 16/461,379

(22) PCT Filed: Oct. 27, 2017

(86) PCT No.: PCT/JP2017/038899
§ 371 (c)(1),
(2) Date: May 16, 2019

(87) PCT Pub. No.: WO2018/100943
PCT Pub. Date: Jun. 7, 2018

(65) Prior Publication Data

US 2021/0197350 A1 Jul. 1, 2021

(30) Foreign Application Priority Data

Nov. 30, 2016 (JP) ..... JP2016-232923
Apr. 17, 2017 (JP) ..... JP2017-081099

(51) Int. Cl.
*B25C 1/06* (2006.01)
*B25C 1/04* (2006.01)

(52) U.S. Cl.
CPC ..... *B25C 1/047* (2013.01); *B25C 1/041* (2013.01); *B25C 1/06* (2013.01)

(58) Field of Classification Search
CPC ..... B25C 1/047; B25C 1/06; B25C 1/041; B25C 1/04; B25C 1/042–043
(Continued)

(56) References Cited

U.S. PATENT DOCUMENTS 6,607,111 B2 * 8/2003 Garvis ..... B25C 1/06 173/124
8,393,512 B2 * 3/2013 Tanimoto ..... B25C 1/06 227/146

(Continued)

FOREIGN PATENT DOCUMENTS

CN 101631648 1/2010
CN 101934515 1/2011

(Continued)

OTHER PUBLICATIONS

"International Search Report (Form PCT/ISA/210)" of PCT/JP2017/038899, dated Jan. 30, 2018, with English translation thereof, pp. 1-2.

(Continued)

*Primary Examiner* — Valentin Neacsu
(74) *Attorney, Agent, or Firm* — JCIPRNET

(57) ABSTRACT

A driver has: a strike section moving in a first direction to strike a fastener; and a bumper contacting the strike section and restricting the range of movement of the strike section in the first direction. The driver further has: a support section for supporting the bumper; a connection section connected to the support section and disposed in a direction intersecting the first direction; a drive section supported by the connection section and moving the strike section in a second direction; a first receiving section which, when the strike section moves in the first direction to hit the bumper, receives a load acting on the support section in the first direction; and a second receiving section which, when the strike section moves in the first direction to hit the bumper, receives a load acting on the support section in the circumferential direction about a first centerline of the drive section.

12 Claims, 19 Drawing Sheets

(58) Field of Classification Search
USPC ..... 227/120, 130, 131
See application file for complete search history.

(56) References Cited

U.S. PATENT DOCUMENTS

| | | | | |
|---|---|---|---|---|
| 10,967,491 | B2 * | 4/2021 | Yasutomi | B25C 1/06 |
| 2004/0011846 | A1 | 1/2004 | Aoki et al. | |
| 2006/0169736 | A1 | 8/2006 | Wen | |
| 2010/0089963 | A1 | 4/2010 | Franz et al. | |
| 2011/0000949 | A1 * | 1/2011 | Ito | B25C 1/06 227/138 |
| 2016/0214248 | A1 * | 7/2016 | Pedicini | B25C 1/047 |
| 2016/0229043 | A1 | 8/2016 | Wyler et al. | |
| 2016/0288305 | A1 * | 10/2016 | McCardle | B25C 1/06 |
| 2018/0154505 | A1 * | 6/2018 | Sato | B25C 1/06 |
| 2018/0178361 | A1 * | 6/2018 | Kabbes | B25C 1/06 |
| 2019/0321955 | A1 * | 10/2019 | Carrier | B25C 1/04 |
| 2020/0114500 | A1 * | 4/2020 | Bierdeman | B25C 1/06 |
| 2020/0282535 | A1 * | 9/2020 | Shige | B25C 5/15 |
| 2020/0391364 | A1 * | 12/2020 | Yasutomi | B25C 1/008 |
| 2021/0101272 | A1 * | 4/2021 | Saitou | B25D 16/00 |

FOREIGN PATENT DOCUMENTS

| | | |
|---|---|---|
| CN | 101939143 | 1/2011 |
| DE | 102008042699 | 4/2010 |
| JP | 2000006051 | 1/2000 |
| JP | 2015199154 | 11/2015 |
| JP | 5849920 | 2/2016 |
| JP | 2016068173 | 5/2016 |

OTHER PUBLICATIONS

"Search Report of Europe Counterpart Application", dated Jul. 7, 2020, p. 1-p. 8.

Office Action of China Counterpart Application, with English translation thereof, dated Sep. 16, 2021, pp. 1-15.

* cited by examiner

13: SUPPORT SECTION
51: CONNECTION SECTION
92: FIRST RECEIVING SECTION
93: SECOND RECEIVING SECTION

DRIVER

CROSS-REFERENCE TO RELATED APPLICATION

This application is a 371 application of the international PCT application serial no. PCT/JP2017/038899, filed on Oct. 27, 2017, which claims the priority benefits of Japan application no. 2016-232923, filed on Nov. 30, 2016 and Japan application no. 2017-081099, filed on Apr. 17, 2017. The entirety of each of the above-mentioned patent applications is hereby incorporated by reference herein and made a part of this specification.

TECHNICAL FIELD

The present invention relates to a driver in which a strike section is moved to strike a fastener.

BACKGROUND ART

Conventionally, a driver that has a strike section which moves in a first direction to strike a fastener, a bumper which restricts the range in which the strike section moves in the first direction, and a support section for supporting the bumper is known, and such a driver is disclosed in Patent Literature 1. The driver has a housing, and the housing has a main body and a support section provided in the main body. The bumper is supported by the support section. Also, the driver has a grip section extended from the main body, and a sub-body extended substantially in parallel with the grip portion from the main body.

The driver disclosed in Patent Document 1 includes a cylindrical guide section provided in the main body, a piston movable in the cylindrical guide section, a driver blade fixed to the piston, a bellows connected to the piston, and a pressure chamber formed in the bellows. The piston and driver blade are the strike section.

In addition, the driver includes a motor provided in the sub-body, a gear group to which a rotational force is transmitted from the motor, and a cam which rotates by the transmitted rotational force from the gear group. The cam has a protrusion which is engageable and disengageable with the piston.

In the driver disclosed in Patent Literature 1, the rotational force of the motor is transmitted to the cam via the gear group. When the protrusion is engaged with the piston, the power of the cam causes the piston to move from a bottom dead point to a top dead point. As the piston moves from the bottom dead point to the top dead point, the pressure in the pressure chamber rises. When the piston reaches the top dead point, the protrusion disengages from the piston and the power of the cam is not transmitted to the piston. Then, the pressure in the pressure chamber moves the strike section, and the driver blade strikes the nail into an object. After the driver blade has driven the nail in, the piston hits the bumper.

CITATION LIST

Patent Literature

[Patent Literature 1] Japanese Patent No. 5849920

SUMMARY OF INVENTION

Technical Problem

However, when a part of the load received by the bumper is transmitted to the sub-body via the support section and displaces a drive section in a driving direction relative to the support section, stress concentration may occur in the support section.

An object of the present invention is to provide a driver in which occurrence of stress concentration in a support section can be suppressed.

Solution to Problem

A driver according to one embodiment is a driver that includes a strike section which moves in a first direction to strike a fastener and a bumper which comes into contact with the strike section and restricts the range in which the strike section moves in the first direction, the driver including a support section which supports the bumper, a connection section which is connected to the support section and is disposed in a direction intersecting the first direction, a drive section which is supported by the connection section and moves the strike section in a second direction, a first receiving section which receives a load acting on the support section in the first direction when the strike section moves in the first direction to hit the bumper, and a second receiving section which receives a load acting on the support section in a circumferential direction about a first centerline of the drive section when the strike section moves in the first direction to hit the bumper.

Advantageous Effects of Invention

In the driver according to one embodiment, the first receiving section receives the load acting on the support section in the first direction, and the second receiving section receives the load acting on the support section in the circumferential direction. Therefore, the occurrence of stress concentration in the support section can be suppressed.

DESCRIPTION OF EMBODIMENTS

One embodiment of a driver will be described with reference to the drawings.

Figure 1:
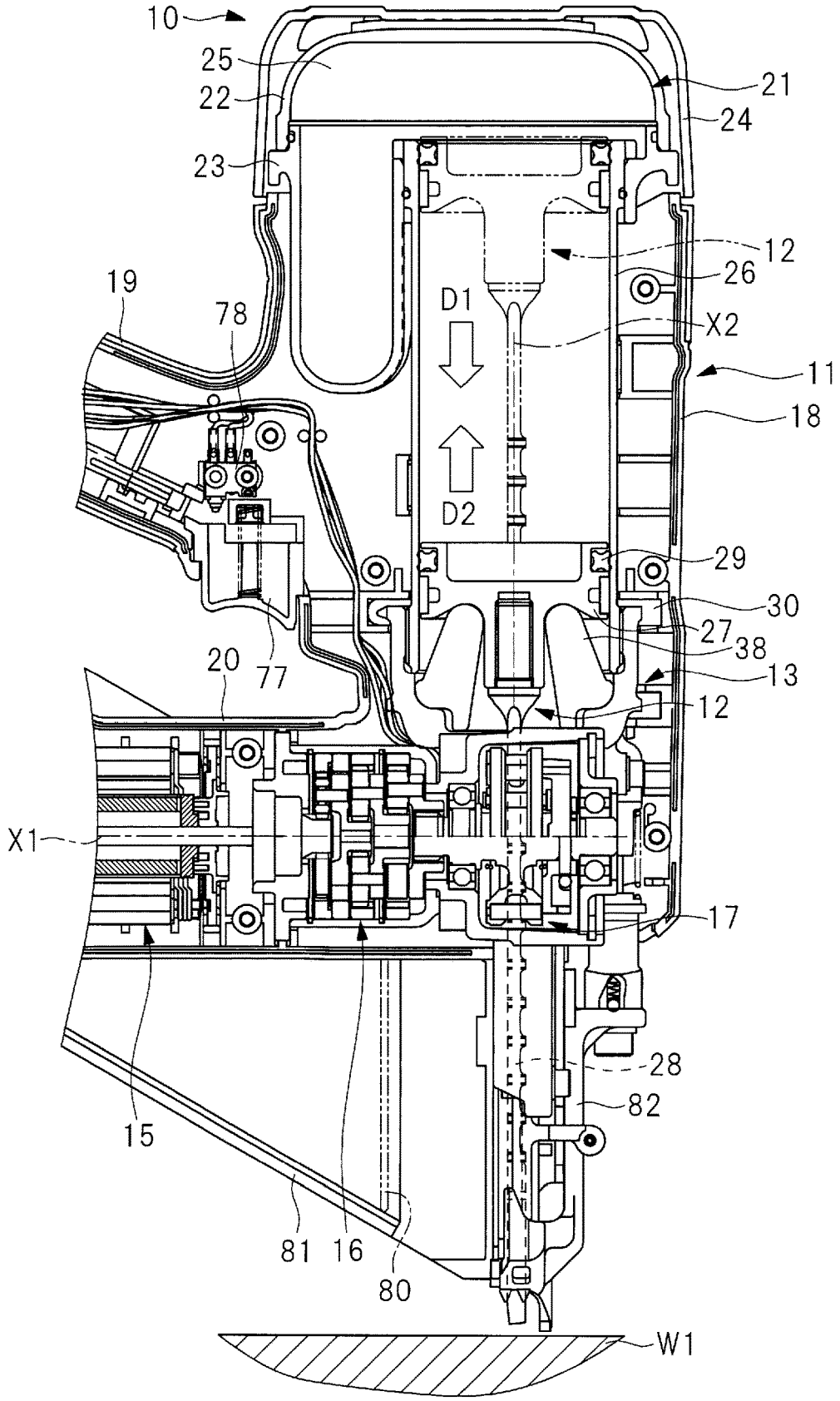
FIG. 1 is a side cross-sectional view showing a part of a driver according to an embodiment of the present invention.
Figure 2:
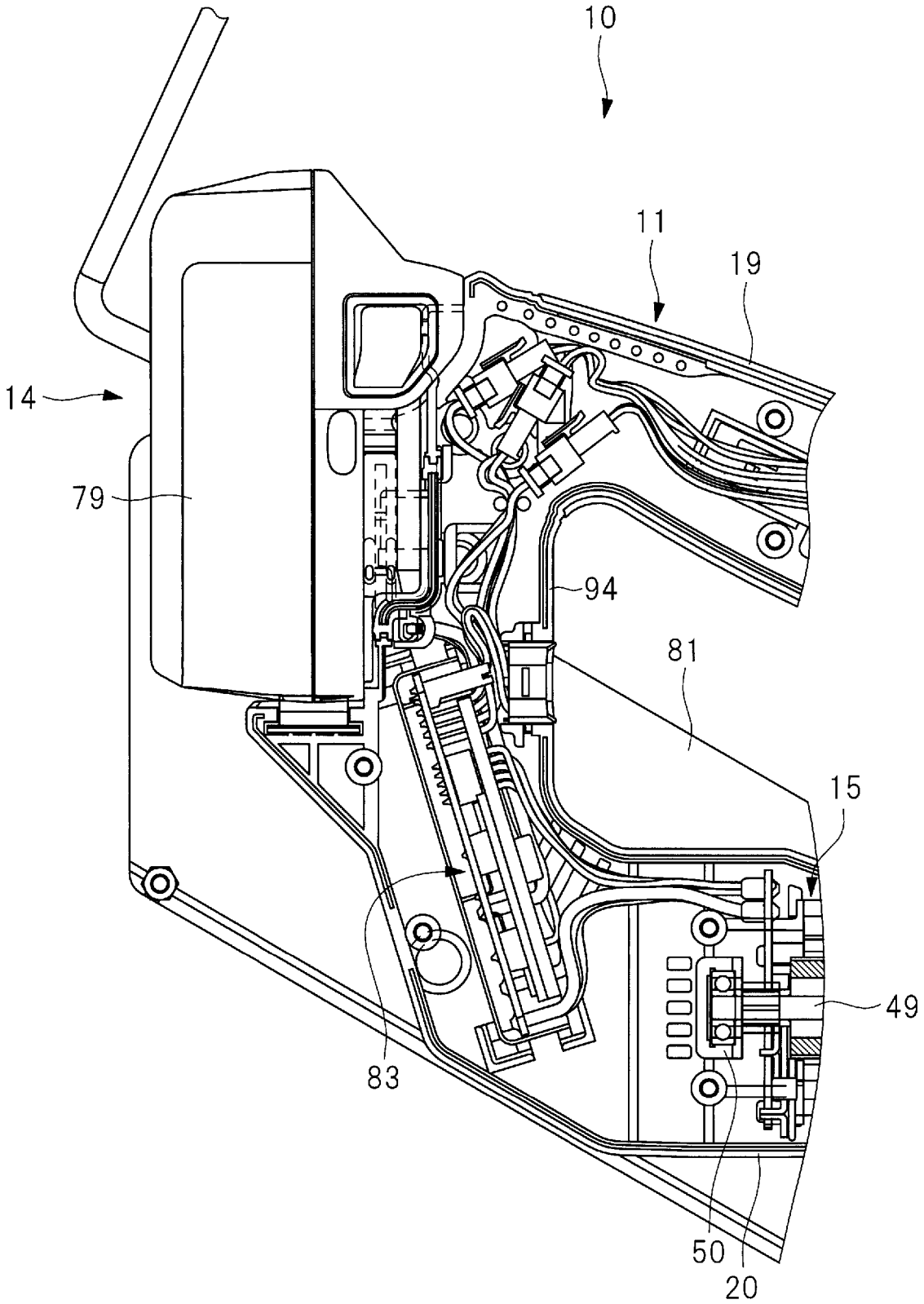
FIG. 2 is a side cross-sectional view showing a part of the driver.

The driver 10 shown in FIGS. 1 and 2 has a housing 11, a strike section 12, a nose section 13, a power supply section 14, an electric motor 15, a speed reduction mechanism 16, a conversion mechanism 17, and a pressure accumulation container 21. The housing 11 is an outer shell element of the driver 10, and the housing 11 has a cylinder case 18, a handle 19 connected to the cylinder case 18, a motor case 20 connected to the cylinder case 18, and a mounting section 94 connected to the handle 19 and the motor case 20.

The power supply section 14 is attachable to and detachable from the mounting section 94. The electric motor 15 is disposed in the motor case 20. The pressure accumulation container 21 has a cap 22 and a holder 23 to which the cap 22 is attached. A head cover 24 is attached to the cylinder case 18, and the pressure accumulation container 21 is disposed across inside the cylinder case 18 and the head cover 24. A pressure chamber 25 is provided in the pressure accumulation container 21. A gas is filled into the pressure chamber 25. A gas may be any compressible gas, and in addition to air, an inert gas such as nitrogen gas or a rare gas can be used as the gas. In the present disclosure, an example in which the pressure chamber 25 is filled with air will be described.

A cylinder 26 is accommodated in the cylinder case 18. The cylinder 26 is made of a metal. The cylinder 26 is positioned relative to the cylinder case 18 in a direction of a second center line X2 and in a radial direction. The strike section 12 is disposed over the inside and the outside of the housing 11. The strike section 12 has a piston 27 and a driver blade 28. The piston 27 is accommodated in the cylinder 26 to be movable in the direction of the second center line X2 of the cylinder 26. The piston 27 is made of a metal, for example, aluminum. A seal member 29 is attached to an outer circumferential surface of the piston 27. An outer circumferential surface of the seal member 29 comes into contact with an inner circumferential surface of the cylinder 26 to form a seal surface.

The driver blade 28 is made of a metal. The piston 27 and the driver blade 28 are provided as separate members, and the piston 27 and the driver blade 28 are connected to each other. The strike section 12 is movable in the direction of the second center line X2.

The nose section 13 is disposed across the inside and the outside of the cylinder case 18. A holder 30 is provided in the cylinder case 18. The holder 30 supports the nose section 13 via an elastic member, for example, a synthetic rubber. That is, the nose section 13 is positioned in the second center line X2 direction relative to the cylinder case 18, and is positioned in the radial direction of the cylinder 26.

Figure 3:
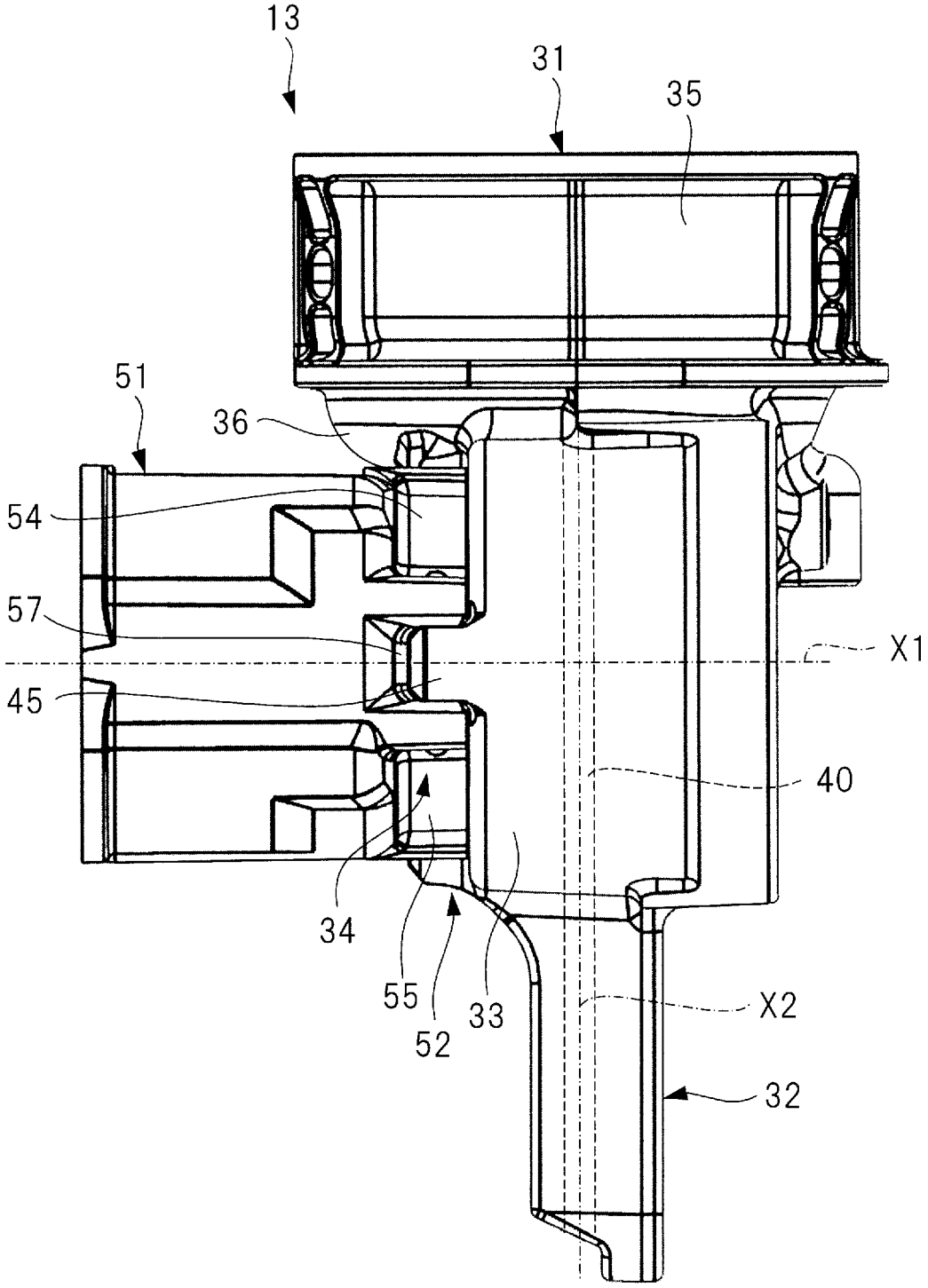
FIG. 3 is a side view of a nose section and a gear case of the driver.
Figure 4:
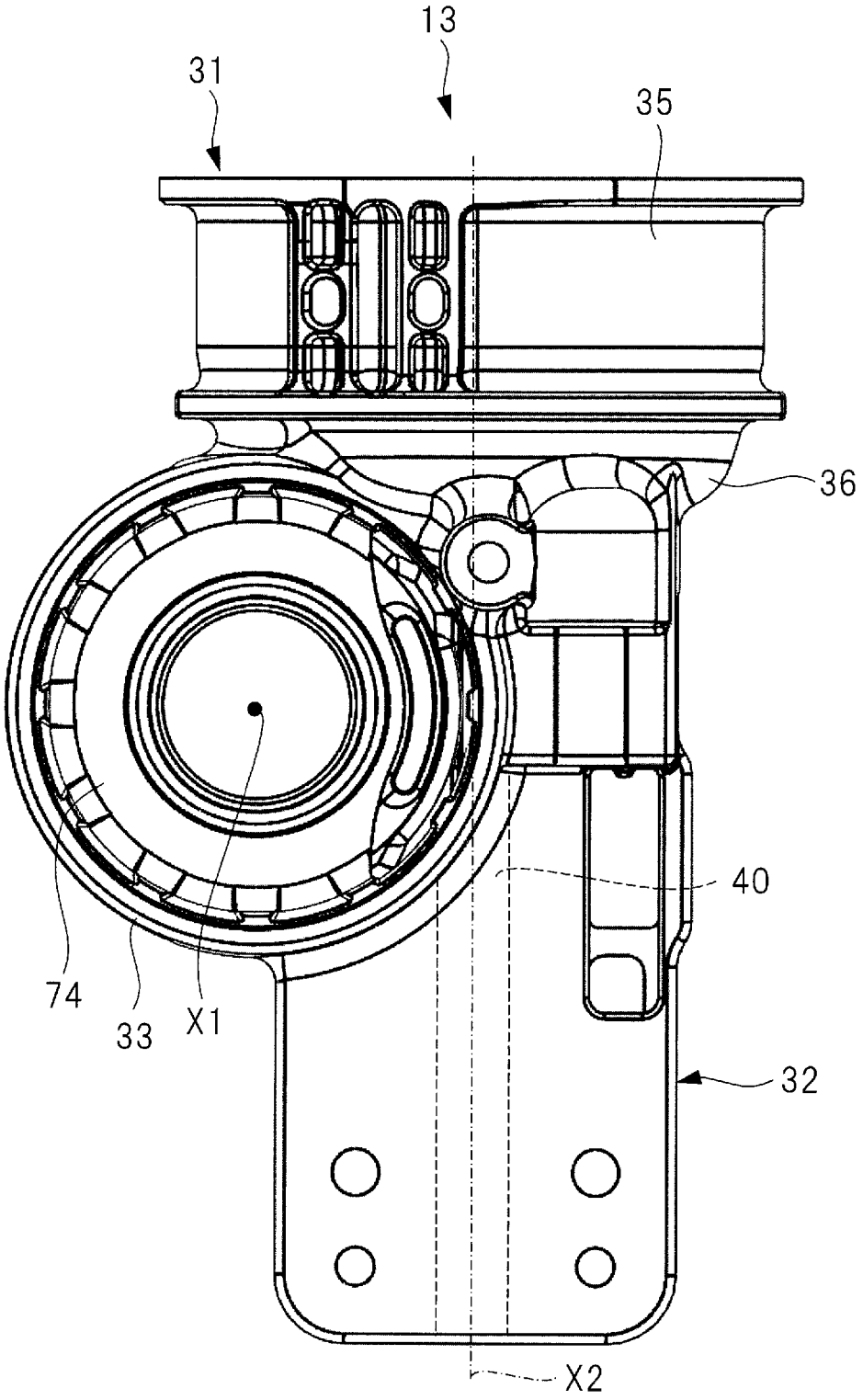
FIG. 4 is a front view of the nose section of the driver.
Figure 5:
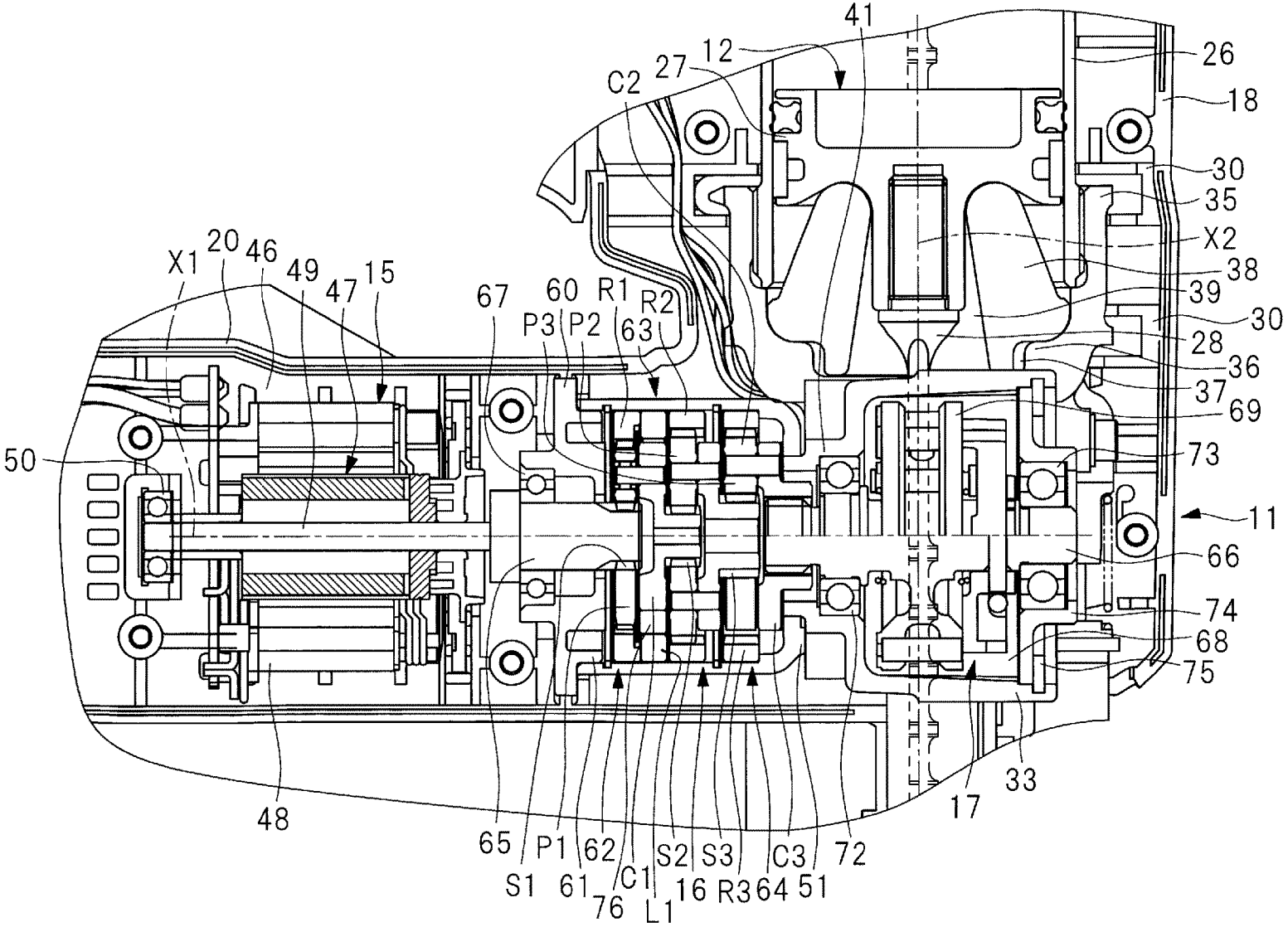
FIG. 5 is a side cross-sectional view showing the inside of the driver.

As shown in FIG. 3, the nose section 13 has a bumper support section 31, an injection section 32, a cylindrical section 33 and a first coupling section 34. As shown in FIGS. 3 and 4, the bumper support section 31 has a cylindrical section 35, and a base section 36 which is connected to the cylindrical section 35 and extends in a direction intersecting the second center line X2. The cylindrical section 35 and the cylinder 26 are connected using screw coupling. The base section 36 has a guide hole 37 as shown in FIG. 5. The guide hole 37 is disposed about the second center line X2. The driver blade 28 is movable in the guide hole 37 in the direction of the second center line X2.

A bumper 38 is disposed in the cylindrical section 35. The bumper 38 is annular, and the bumper 38 has a guide hole 39. The guide hole 39 is provided around the second center line X2. The driver blade 28 is movable in the guide hole 39 in the direction of the second center line X2. The bumper 38 is supported by the base section 36 and is positioned in the direction of the second center line X2. The bumper 38 absorbs the kinetic energy of the strike section 12 by being elastically deformed in response to an impact from the piston 27. The bumper 38 is integrally formed of a synthetic rubber, for example, an elastomer. In particular, a thermosetting elastomer which has excellent heat resistance may be used. In addition, when the piston 27 moves toward the injection section 32, the bumper 38 serves as a stopper which restricts the range in which the piston 27 moves in the direction of the second center line X2.

The injection section 32 is connected to the bumper support section 31 and protrudes from the bumper support section 31 in the direction of the second center line X2. The injection section 32 has an injection passage 40, and the injection passage 40 is provided along the second center line X2. The driver blade 28 is movable in the injection passage 40 in the direction of the second center line X2.

Figure 6:
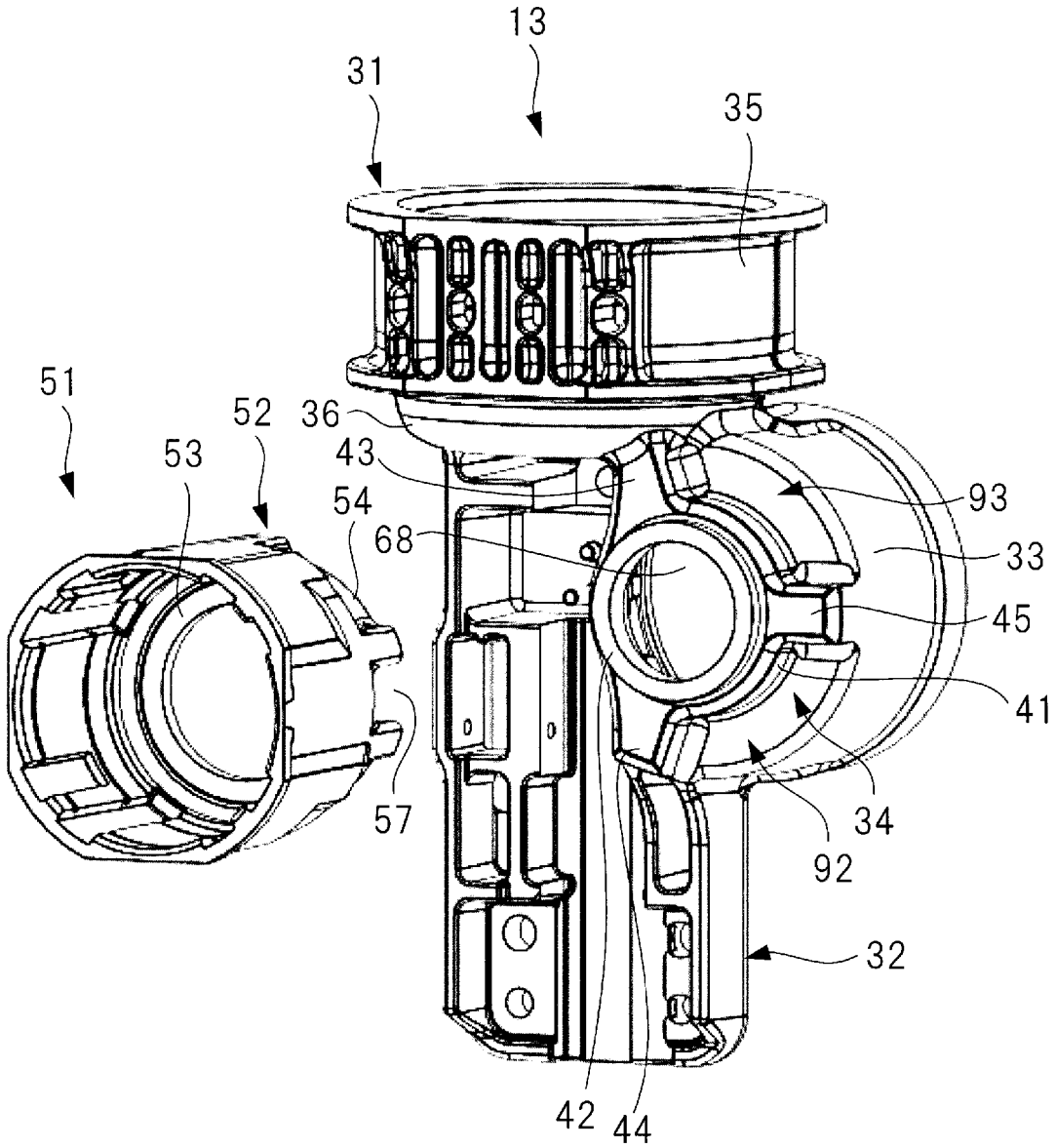
FIG. 6 is an exploded perspective view showing the nose section and the gear case of the driver.
Figure 7:
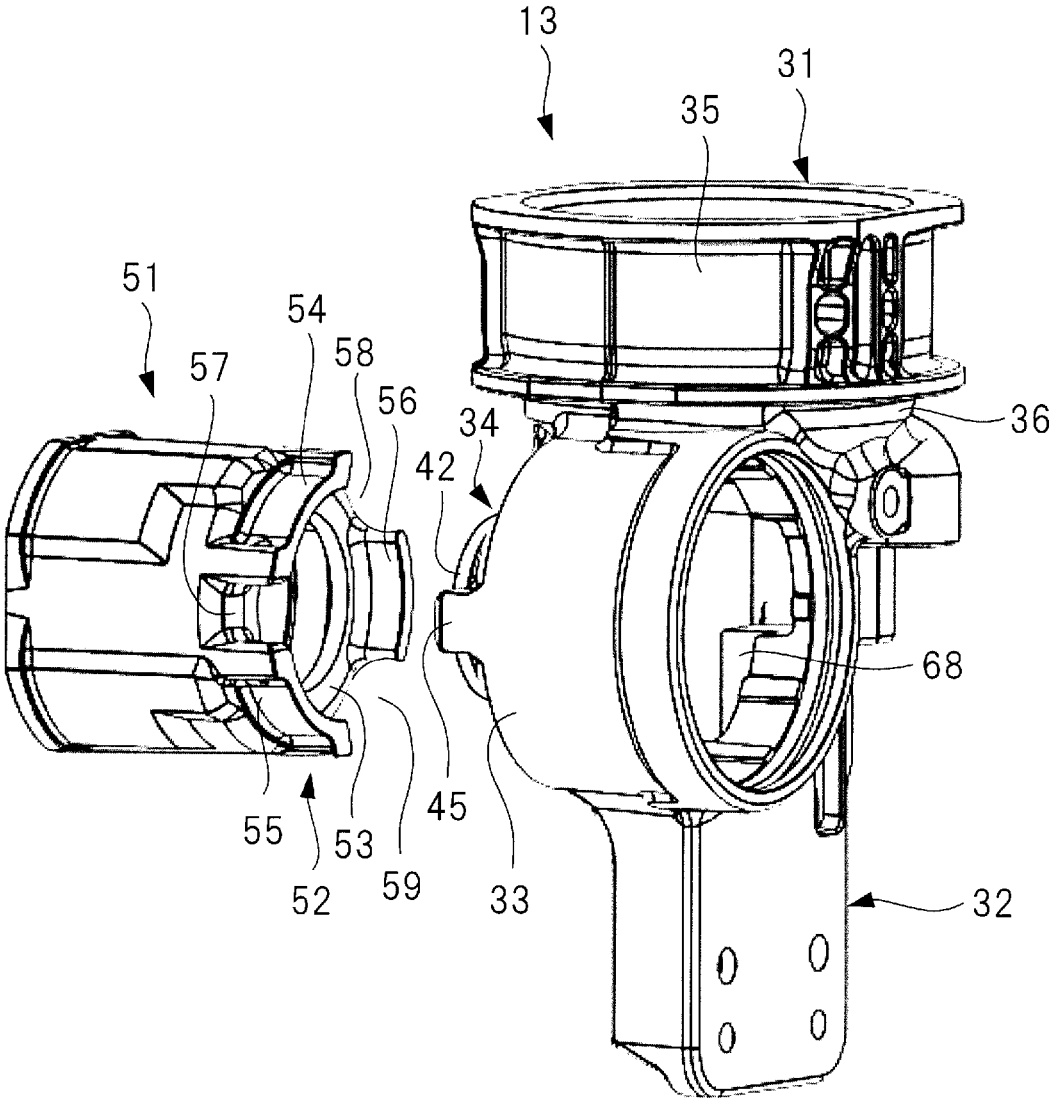
FIG. 7 is an exploded perspective view showing the nose section and the gear case of the driver.

When the nose section 13 is viewed from the front as shown in FIG. 4, a first center line X1 of the cylindrical section 33 is disposed at a position deviated with respect to the second center line X2. As shown in FIGS. 6 and 7, an accommodation chamber 68 is formed in the cylindrical section 33. The first coupling section 34 has a cylindrical boss section 41, a sleeve 42 protruding from the boss section 41 in a direction of the first center line X1, and a first protrusion 43, a second protrusion 44 and a third protrusion 45 which protrude from an outer circumferential surface of the boss section 41. The sleeve 42 is provided about the first center line X1 and extends in the direction of the first center line X1. The first protrusion 43, the second protrusion 44 and the third protrusion 45 are disposed at different positions in a circumferential direction of the sleeve 42.

Among the first to third protrusions 43 to 45, the first protrusion 43 is disposed at a position closest to the bumper support section 31 in the direction of the second center line X2. Among the first to third protrusions 43 to 45, the second protrusion 44 is disposed at a position most distant from the bumper support section 31 in the direction of the second center line X2. The third protrusion 45 is disposed between the first protrusion 43 and the second protrusion 44 in the direction of the second center line X2.

The first protrusion 43 and the second protrusion 44 protrude from the boss section 41 in the direction of the second center line X2. The first protrusion 43 is connected to the bumper support section 31, and the second protrusion 44 is connected to the injection section 32. The direction in which the third protrusion 45 protrudes from the boss section 41 is away from the second center line X2. Also, the first protrusion 43 extends from the boss section 41 in a second direction D2. The second protrusion 44 extends from the boss section 41 in a first direction D1. Further, the first protrusion 43, the second protrusion 44, and the third protrusion 45 extend radially outward from the boss section 41.

As shown in FIG. 5, a motor accommodation chamber 46 is provided in the motor case 20, and the electric motor 15 is disposed in the motor accommodation chamber 46. The electric motor 15 has a rotor 47 and a stator 48. The stator 48 is attached to the motor case 20. The rotor 47 is attached to a rotor shaft 49, and a first end of the rotor shaft 49 is rotatably supported by the motor case 20 via a bearing 50. A radial gap, that is, an air gap, is formed between the rotor 47 and the stator 48. The stator 48 is obtained by winding a conductive wire around a stator core. The electric motor 15 is a brushless motor.

As shown in FIG. 5, a gear case 51 is provided in the motor case 20. The gear case 51 has a cylindrical shape and is disposed around the first center line X1. The second coupling section 52 shown in FIG. 7 is provided at a first end of the gear case 51 in the direction of the first center line X1. The second coupling section 52 includes a flange 53, a first arc section 54, a second arc section 55, and a third arc section 56. The flange 53 protrudes inward from an inner surface of the gear case 51.

The flange 53 is provided on the entire circumference of the gear case 51 about the second center line X2, and the first to third arc sections 54 to 56 are disposed outside the flange 53 in a radial direction of the gear case 51. The first to third arc sections 54 to 56 are disposed at different positions in the circumferential direction. The first arc section 54 and the second arc section 55 have a line symmetrical shape with a line segment passing through the first center line X1 interposed therebetween.

Figure 8:
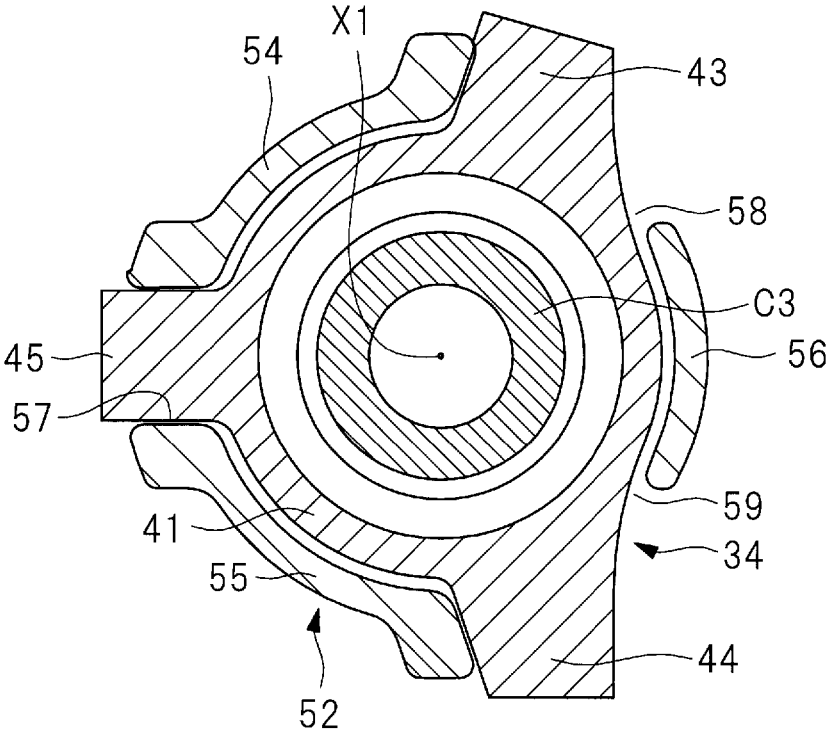
FIG. 8 is a cross-sectional view showing a specific example of a first coupling section and a second coupling section of the driver.

As shown in FIG. 8, the first arc section 54 and the second arc section 55 are disposed within a range of approximately 190 degrees in the circumferential direction of the gear case 51. The third arc section 56 is disposed at substantially a center of the range in which the first arc section 54 and the second arc section 55 are not disposed in the circumferential direction of the gear case 51. A first notch section 57 is formed between the first arc section 54 and the second arc section 55 in the circumferential direction of the gear case 51. The second notch section 58 is formed between the first arc section 54 and the third arc section 56 in the circumferential direction of the gear case 51. The third notch section 59 is formed between the second arc section 55 and the third arc section 56 in the circumferential direction of the gear case 51.

Figure 9:
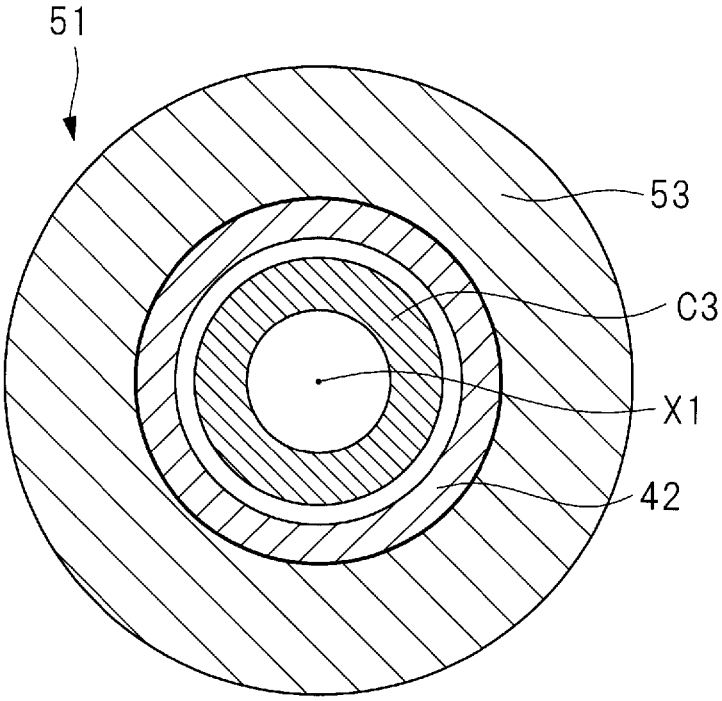
FIG. 9 is a cross-sectional view showing a coupling section between the gear case and a sleeve of the driver.

In addition, when the first coupling section 34 and the second coupling section 52 are fitted, that is, coupled to each other, the first protrusion 43 is disposed in the second notch section 58, the second protrusion 44 is disposed in the third notch section 59, and the third protrusion 45 is disposed in the first notch section 57. The first arc section 54 comes into contact with the first protrusion 43 or the third protrusion 45, and the second arc section 55 comes into contact with the second protrusion 44 or the third protrusion 45, whereby the gear case 51 is positioned relative to the boss section 41 in the circumferential direction about the first center line X1. That is, the first protrusion 43, the second protrusion 44, and the third protrusion 45 are a rotation prevention mechanism which prevents the gear case 51 from rotating relative to the nose section 13. Further, when the first coupling section 34 and the second coupling section 52 are coupled, an inner circumferential end of the flange 53 comes into contact with an outer circumferential surface of the sleeve 42, so that the gear case 51 is positioned in the radial direction with respect to boss section 41, as shown in FIG. 9.

The nose section 13 and the gear case 51 are configured as separate members as shown in FIGS. 6 and 7. The first coupling section 34 and the second coupling section 52 are a mechanism which positions the nose section 13 and the gear case 51 to each other in the direction of the first center line X1 and positions them relative to each other in the circumferential direction about the first center line X1.

As shown in FIG. 5, a partition wall 60 is provided in the motor case 20. The partition wall 60 is positioned and fixed with respect to the motor case 20 in the direction of the first center line X1. The partition wall 60 partitions the inside of the gear case 51 and the motor accommodation chamber 46. The support section 61 is provided on the partition wall 60. The support section 61 is a sleeve centered on the first center line X1, and a second end of the gear case 51 is supported by the support section 61. That is, the second end of the gear case 51 is positioned by the support section 61 in the radial direction. Further, the first end of the gear case 51 is in contact with the boss section 41 and the second end of the gear case 51 is in contact with the partition wall 60. Therefore, the gear case 51 is positioned in the direction of the first center line X1. Thus, the gear case 51 is supported by the nose section 13 and the partition wall 60.

The speed reduction mechanism 16 is provided in the gear case 51. The speed reduction mechanism 16 includes a first planetary gear mechanism 62, a second planetary gear mechanism 63, and a third planetary gear mechanism 64, and the first planetary gear mechanism 62 to the third planetary gear mechanism 64 are disposed concentrically about the first center line X1.

The second planetary gear mechanism 63 is disposed between the first planetary gear mechanism 62 and the third planetary gear mechanism 64 in the direction along the first center line X1. The first planetary gear mechanism 62 includes a first sun gear S1, a first ring gear R1 disposed concentrically with the first sun gear 51, and a first carrier C1 which supports a first pinion gear P1 engaged with the first sun gear 51 and the first ring gear R1 to be able to rotate and revolve. The first sun gear 51 is an input element of the speed reduction mechanism 16.

The second planetary gear mechanism 63 includes a second sun gear S2, a second ring gear R2 disposed concentrically with the second sun gear S2, and a second carrier C2 which supports a second pinion gear P2 engaged with the second sun gear S2 and the second ring gear R2 to be able to rotate and revolve. The second sun gear S2 is connected to the first carrier C1 to rotate integrally therewith.

The third planetary gear mechanism 64 includes a third sun gear S3, a third ring gear R3 disposed concentrically with the third sun gear S3, and a third carrier C3 which supports a third pinion gear P3 engaged with the third sun gear S3 and the third ring gear R3 to be able to rotate and revolve. The third sun gear S3 is connected to rotate integrally with the second carrier C2. The third carrier C3 is an output element of the speed reduction mechanism 16.

The first sun gear S1 of the speed reduction mechanism 16 is formed on an outer circumferential surface of a power transmission shaft 65. A rotating shaft 66 is provided in the accommodation chamber 68, and the third carrier C3 of the speed reduction mechanism 16 is connected to the rotating shaft 66 to rotate integrally therewith. The power transmission shaft 65 is connected to the rotor shaft 49 to rotate integrally therewith, and the power transmission shaft 65 is supported by the partition wall 60 via a fourth bearing 67. The rotor shaft 49, the power transmission shaft 65, the speed reduction mechanism 16, and the rotating shaft 66 are disposed concentrically around the first center line X1. The speed reduction mechanism 16 is disposed between the electric motor 15 and the cylindrical section 33 in the direction of the first center line X1. The gear case 51 is disposed between the cylindrical section 33 and the partition wall 60 in the direction of the first center line X1. The speed reduction mechanism 16 is disposed in a power transmission path from the electric motor 15 to the rotating shaft 66.

The gear case 51 supports the first ring gear R1, the second ring gear R2, the third ring gear R3 and a lock ring L1 in a non-rotatable manner. When the rotational force of the electric motor 15 is input to the speed reduction mechanism 16 and output from the rotating shaft 66, the first ring gear R1, the second ring gear R2 and the third ring gear R3 function as reaction force elements.

Figure 10:
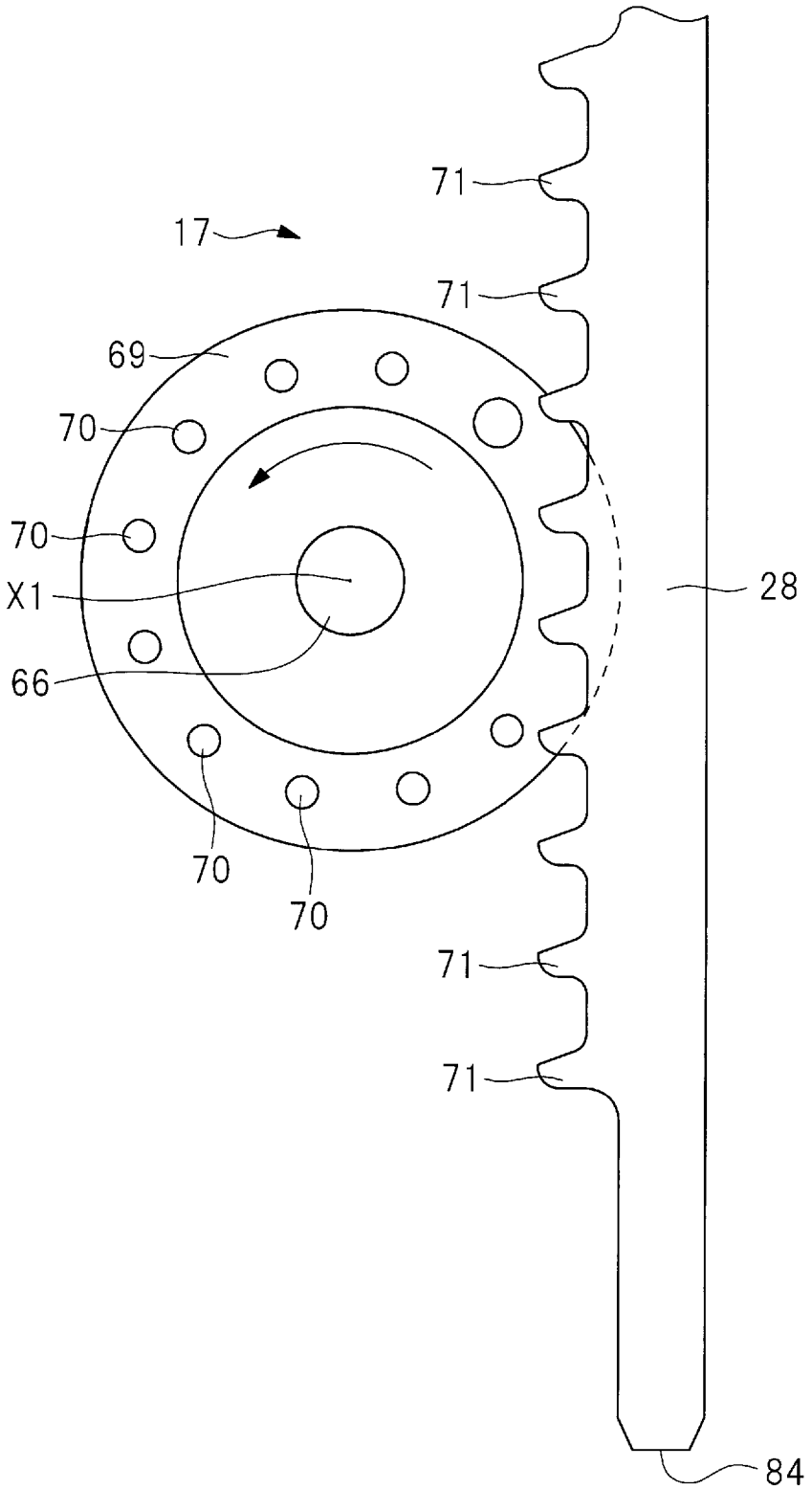
FIG. 10 is a front view of a conversion mechanism of the driver.

The conversion mechanism 17 is disposed in the accommodation chamber 68. The conversion mechanism 17 converts the rotational force of the rotating shaft 66 into a moving force of the driver blade 28. As shown in FIG. 10, the conversion mechanism 17 includes a pin wheel 69 fixed to the rotating shaft 66, pinion pins 70 provided in the pin wheel 69, and protruding portions 71 provided on the driver blade 28. A plurality of pinion pins 70 are disposed at intervals in a rotating direction of the pin wheel 69. As shown in FIG. 5, two bearings 72 and 73 for supporting the rotating shaft 66 are provided. The bearing 72 is supported by the boss section 41. The bearing 73 is supported by the cylindrical section 33 via the holder 74. A stopper 75 is attached to the cylindrical section 33, and the stopper 75 prevents the holder 74 from coming out from the cylindrical section 33.

As shown in FIG. 10, a plurality of protruding portions 71 are disposed at intervals in a moving direction of the driver blade 28. The pinion pins 70 can be engaged with and released from the protruding portions 71. When the pin wheel 69 rotates counterclockwise and the pinion pins 70 engages with the protruding portions 71 in FIG. 10, the rotational force of the pin wheel 69 is transmitted to the driver blade 28. For this reason, the strike section 12 moves in the second direction D2 in FIG. 1. When the pinion pins 70 are released from the protruding portions 71, the rotational force of the pin wheel 69 is not transmitted to the driver blade 28.

The strike section 12 is constantly urged in the first direction D1 due to the pressure of the pressure chamber 25. The movement of the strike section 12 in the second direction D2 in FIG. 1 is referred to as going up. The first direction D1 and the second direction D2 are parallel to the second center line X2, and the second direction D2 is opposite to the first direction D1. The strike section 12 moves in the second direction D2 against the pressure of the pressure chamber 25.

A rotation restricting mechanism 76 is provided in the accommodation chamber 68. The rotation restricting mechanism 76 is provided in the gear case 51. The rotation restricting mechanism 76 includes rolling elements such as rollers or balls. The rotation restricting mechanism 76 is interposed between the first carrier C1 and the lock ring L1. The first carrier C1 is rotatable in the first direction relative to the lock ring L1. When the first carrier C1 tries to rotate in the second direction relative to the lock ring L1, a wedge action of the rotation restricting mechanism 76 prevents the rotation of the first carrier C1. For this reason, the rotation restricting mechanism 76 allows the rotating shaft 66 to rotate with the rotational force transmitted from the electric motor 15. When the rotational force acts on the pin wheel 69 due to the force of the driver blade 28, the rotation restricting mechanism 76 prevents the rotating shaft 66 from rotating. That is, when the rotational force acts on the pin wheel 69 due to the force of the driver blade 28, the rotational force is transmitted to the nose section 13 via the first carrier C1, the rotation restricting mechanism 76, the lock ring L1, and the gear case 51, and therefore, the nose section 13 receives the rotational force.

As shown in FIG. 1, a trigger 77 is provided in the handle 19. An operator grasps the handle 19 and operates the trigger 77. A trigger switch 78 is provided in the handle 19. The trigger switch 78 is turned on when an operating force is applied to the trigger 77 and is turned off when the operating force of the trigger 77 is released.

The power supply section 14 supplies power to the electric motor 15. The power supply section 14 has a housing case 79 and a plurality of battery cells accommodated in the housing case 79. The battery cell is a secondary battery capable of charging and discharging, and any of a lithium ion battery, a nickel hydrogen battery, a lithium ion polymer battery, and a nickel cadmium battery can be used for the battery cell.

Also, a magazine 81 for accommodating nails 80 is provided, and the magazine 81 is supported by the injection section 32 and the mounting section 94. The nail 80 may be either with or without a head. A plurality of nails 80 are accommodated in the magazine 81. The magazine 81 has a feeder, and the feeder is movable in a longitudinal direction of the magazine 81.

The injection section 32 is made of a metal or a synthetic resin. The feeder supplies the nails 80 accommodated in the magazine 81 to the injection passage 40. A push lever 82 is attached to the injection section 32. The push lever 82 is movable with respect to the injection section 32 in a predetermined range in the direction of the second center line X2.

As shown in FIG. 2, a control section 83 is provided in the mounting section 94. The control section 83 has a substrate, a microcomputer and an inverter circuit. The microcomputer has an input and output interface, an arithmetic processing unit, and a storage unit. The inverter circuit connects and disconnects the stator 48 of the electric motor 15 to and from the power supply section 14. The inverter circuit includes a plurality of switching elements, and the plurality of switching elements can be independently turned on and off. The microcomputer controls the inverter circuit.

In addition, a sensor for detecting a rotational speed of the rotor 47 of the electric motor 15, a phase sensor for detecting a phase of the rotor 47 in a rotating direction thereof, a position detecting sensor for detecting a position of the pin wheel 69 in a rotating direction thereof, and a push sensor for detecting a position of the push lever 82 are provided. The push sensor is turned on when the push lever 82 is pressed against a workpiece W1, and is turned off when the push lever 82 is separated away from the workpiece W1.

Signals output from these sensors and signals of the trigger switch 78 are input to the control section 83. The control section 83 processes the signals of the trigger switch 78 and the signals of various sensors to control the inverter circuit.

Next, a usage example of the driver 10 will be described. When the control section 83 detects at least any one of the trigger switch 78 off and the push sensor off, the control section 83 controls the inverter circuit not to supply the power of the power supply section 14 to the electric motor 15. For this reason, the electric motor 15 is stopped. The pressure of the pressure chamber 25 is applied to the strike section 12, and the strike section 12 is urged in the first direction D1.

The pinion pins 70 and the protruding portions 71 are engaged with each other, the urging force received by the strike section 12 is transmitted to the pin wheel 69, and the pin wheel 69 receives a clockwise rotational force in FIG. 10. The rotation restricting mechanism 76 prevents the rotation of the rotating shaft 66, and the strike section 12 is stopped at a standby position. When the strike section 12 is stopped at the standby position, the piston 27 is stopped between the top dead point and the bottom dead point.

The top dead point of the piston 27 is a position most distant from the bumper 38 in the direction of the second center line X2, as shown by a two-dot chain line in FIG. 1. The bottom dead point of the piston 27 is a position in contact with the bumper 38 in the direction of the second center line X2, as shown by a solid line in FIG. 1. When the strike section 12 is stopped at the standby position, a tip end 84 of the driver blade 28 is positioned between an upper end and a lower end of the nail 80 located at the head of the nail 80 in a feeding direction thereof.

When the control section 83 detects that the trigger switch 78 is turned on and the push switch is turned on, the control section 83 controls the inverter circuit to supply the power of the power supply section 14 to the electric motor 15. The rotational force of the electric motor 15 is transmitted to the rotating shaft 66 via the speed reduction mechanism 16. The rotating shaft 66 and the pin wheel 69 rotate counterclockwise in FIG. 10. The speed reduction mechanism 16 makes a rotational speed of the pin wheel 69 slower than a rotational speed of the electric motor 15.

The rotational force of the pin wheel 69 is transmitted to the strike section 12, and the strike section 12 goes up in FIG. 1. When the strike section 12 goes up, the pressure in the pressure chamber 25 rises. After the piston 27 reaches the top dead point, all the pinion pins 70 are released from the protruding portions 71. The strike section 12 moves in the first direction D1 due to the pressure of the pressure chamber 25. The movement of the strike section 12 in the first direction D1 in FIG. 1 is referred to as going down. The driver blade 28 strikes a single nail 80 in the injection passage 40, and the nail 80 is driven into the workpiece W1.

The piston 27 hits the bumper 38 after the nail 80 is driven into the workpiece W1. The bumper 38 receives a load in the direction of the second center line X2 to be elastically deformed, and the bumper 38 absorbs a part of kinetic energy of the strike section 12. In addition, the control section 83 rotates the electric motor 15 even after the driver blade 28 strikes the nail 80. When the pinion pins 70 engage with the protruding portions 71, the piston 27 moves from the bottom dead point to the top dead point. The control section 83 processes the signals of the position detecting sensor to detect whether or not the strike section 12 has reached the standby position. The control section 83 stops the electric motor 15 when the strike section 12 reaches the standby position.

When the strike section 12 moves in the first direction D1 and the piston 27 hits the bumper 38, a part of the load received by the bumper 38 is transmitted to the base section 36 of the bumper support section 31, and the base section 36 receives a load in the first direction D1. The load in the first direction D1 received by the base section 36 is transmitted to the injection section 32 via the first protrusion 43, the boss section 41, and the second protrusion 44. Thus, the first protrusion 43 and the second protrusion 44 receive the load in the first direction D1.

On the other hand, the motor case 20 protrudes relative to the cylinder case 18 in a direction intersecting the second center line X2. For this reason, at a time after the time when the base section 36 receives the load in the first direction D1, the electric motor 15 and the power supply section 14 are displaced in the first direction D1 with the first coupling section 34 as a fulcrum, that is, they vibrate. The gear case 51 is connected to the cylinder case, and the second end of the gear case 51 is supported by the motor case 20 via the partition wall 60. For this reason, when the electric motor 15 and the power supply section 14 are displaced in the first direction D1, the gear case 51 is displaced relative to the first coupling section 34 in the first direction D1. Then, the first coupling section 34 receives the load in the first direction D1 again at a position connected to the second coupling section 52. Specifically, the sleeve 42 receives a load in the first direction D1 from the flange 53, and the third protrusion 45 receives a load in the first direction D1 from the first arc section 54.

Further, the first center line X1 and the second center line X2 do not intersect, and the electric motor 15 is disposed about the first center line X1. For this reason, the load when the electric motor 15 and the power supply section 14 are displaced in the first direction D1 is generated in parallel with the second center line X2 with a predetermined interval relative to the second center line X2. Then, a circumferential load with respect to the first center line X1, that is, a torsional load is generated on the gear case 51. As a result, the third protrusion 45 receives a torsional load from the first arc section 54, and the second protrusion 44 receives a torsional load from the second arc section 55. The first coupling section 34 is a constituent which receives a load due to the engaging force or meshing force between the first coupling section 34 and the second coupling section 52 when the electric motor 15 and the power supply section 14 are displaced.

As described above, in the case where the electric motor 15 and the power supply section 14 are displaced in the first direction D1 when a predetermined time has elapsed from the time when the piston 27 hits the bumper 38, the first coupling section 34 receives the load in the first direction D1 and the torsional load. For this reason, the rigidity of the nose section 13, particularly, at a position connecting the bumper support section 31 to the injection section 32 is increased. Therefore, it is possible to suppress the occurrence of stress concentration at the nose section 13, particularly at the position connecting the bumper support section 31 to the injection section 32. Thus, a life span of the nose section 13 can be extended.

In addition, since the rigidity of the first coupling section 34 is increased, vibrations transmitted from the gear case 51 to the power transmission shaft 65 and vibrations transmitted from the power transmission shaft 65 to the rotor shaft 49 are reduced when the rotor 47 is displaced in the first direction D1. Thus, a gap formed between the rotor 47 and the stator 48, that is, an air gap, can be secured. Therefore, the contact between the rotor 47 and the stator 48 can be avoided and the reliability of the electric motor 15 is improved.

Another specific example of the first coupling section 34 and the second coupling section 52 shown in FIGS. 6, 7 and 8 will be described with reference to FIGS. 11, 12 and 13. The components in FIGS. 11 and 12 which are the same as those in FIGS. 6 and 7 are denoted by the same reference numerals as in FIGS. 6 and 7. In FIG. 13, the same components as in FIG. 8 are denoted by the same reference numerals as in FIG. 8

Figure 11:
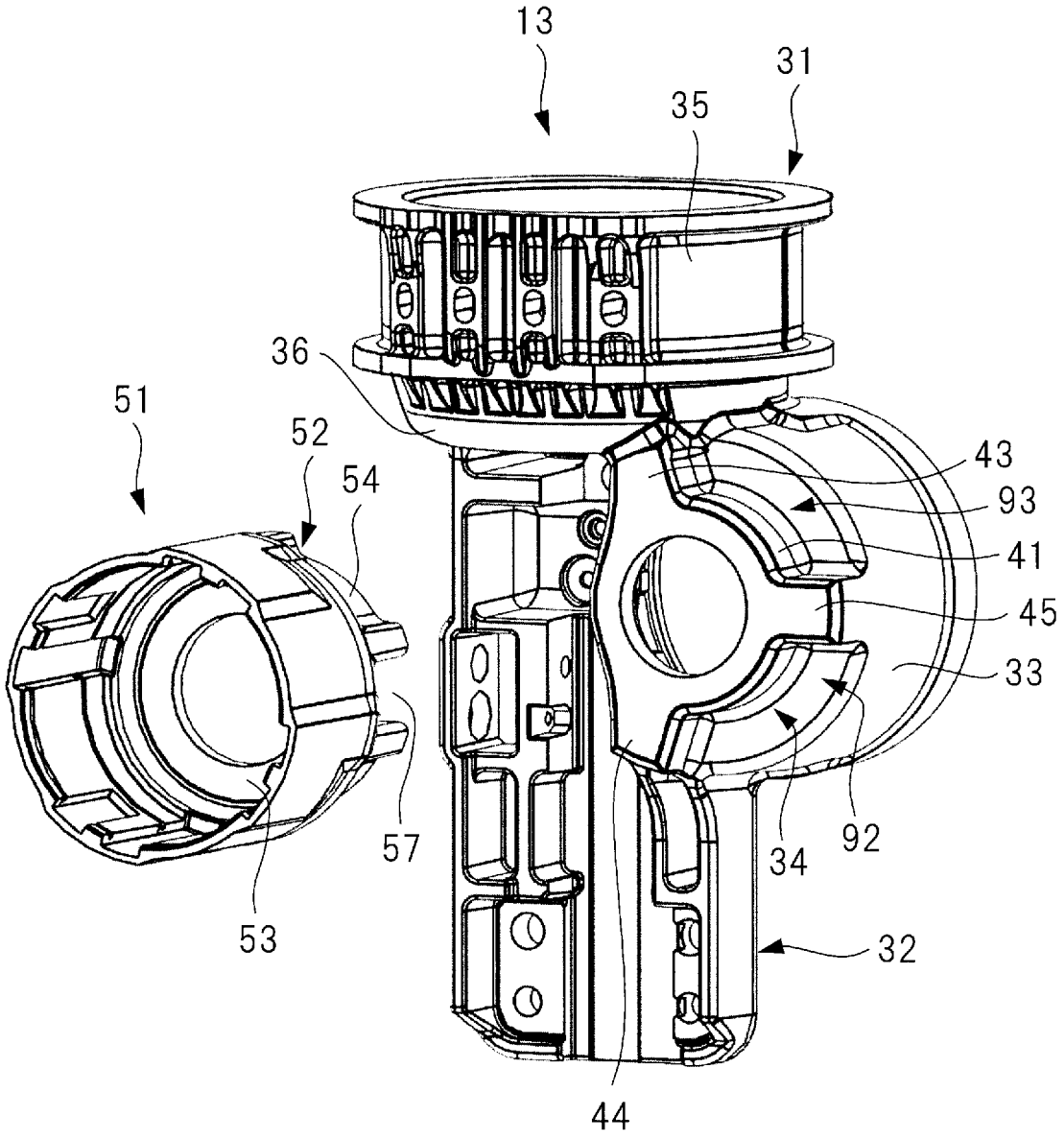
FIG. 11 is an exploded perspective view showing a nose section and a gear case of the driver.

As shown in FIG. 11, the boss section 41 does not include the sleeve 42. Also, as shown in FIG. 13, an outer surface 85 of the boss section 41 positioned between the first protrusion 43 and the third protrusion 45 is in surface contact with the first arc section 54, and receives a load in the first direction D1 in FIG. 1. Further, among outer surfaces of the boss section 41, an outer surface 86 between the first protrusion 43 and the second protrusion 44 is in surface contact with the third arc section 56, and receives a torsional load. As described above, the load is received not at a position where the first coupling section 34 and the second coupling section 52 are in point contact but at a position where there are in surface contact with each other. For this reason, it is possible to suppress an increase in the contact load per unit area at the contact position between the first coupling section 34 and the second coupling section 52. Therefore, it is possible to suppress the occurrence of stress concentration at the position connecting the bumper support section 31 to the injection section 32 in the nose section 13 shown in FIGS. 11 and 12.

Further, an outer surface 87 of the boss section 41 positioned between the second protrusion 44 and the third protrusion 45 is in surface contact with the second arc section 55. In FIG. 1, in a case in which the gear case 51 is displaced in the second direction D2 with first coupling section 34 as a fulcrum because of the reaction after the gear case 51 is displaced in the first direction D1, the boss section 41 receives a load in the second direction D2. Therefore, the occurrence of stress concentration at the position connecting the bumper support section 31 to the injection section 32 can be further suppressed. In addition, in the nose section 13 shown in FIGS. 11 and 12, the same effects can be obtained with the same constituents as in FIGS. 6 and 7.

Another specific example of the first coupling section 34 and the second coupling section 52 shown in FIGS. 11 and 12 will be described with reference to FIGS. 14 and 15. The components in FIGS. 14 and 15 which are the same as those in FIGS. 11 and 12 are denoted by the same reference numerals as in FIGS. 11 and 12.

The first coupling section 34 has a fourth protrusion 88. The fourth protrusion 88 protrudes from the boss section 41. The fourth protrusion 88 is disposed between the third protrusion 45 and the second protrusion 44 in the circumferential direction of the boss section 41. Also, the sleeve 42 is not provided on the boss section 41. The second coupling section 52 has a fourth arc section 89. The fourth arc section 89 is disposed between the first arc section 54 and the second arc section 55 in the circumferential direction of the gear case 51. A fourth notch section 90 is formed between the first arc section 54 and the fourth arc section 89, and a fifth notch section 91 is formed between the second arc section 55 and the fourth arc section 89.

When the first coupling section 34 and the second coupling section 52 are coupled, the first protrusion 43 is disposed in the second notch section 58, the second protrusion 44 is disposed in the third notch section 59, the third protrusion 45 is disposed in the fourth notch section 90, and the fourth protrusion 88 is disposed in the fifth notch section 91. When the nose section 13 shown in FIG. 14 receives a load in the first direction D1 from the bumper 38 in FIG. 1, the load is received by the first protrusion 43 and the second protrusion 44.

Also, when a torsional load acts on the gear case 51, the first arc section 54 is pressed against the first protrusion 43 or the third protrusion 45, the second arc section 55 is pressed against the second protrusion 44 or the fourth protrusion 88, the third arc section 56 is pressed against the first protrusion 43 or the second protrusion 44, and the fourth arc section 89 is pressed against the third protrusion 45 or the fourth protrusion 88. That is, in the first coupling section 34, the first protrusion 43, the second protrusion 44, the third protrusion 45, and the fourth protrusion 88 receive the torsional load. The first protrusion 43, the second protrusion 44, the third protrusion 45, and the fourth protrusion 88 are a rotation stopping mechanism which prevent the gear case 51 from rotating relative to the nose section 13.

Figure 12:
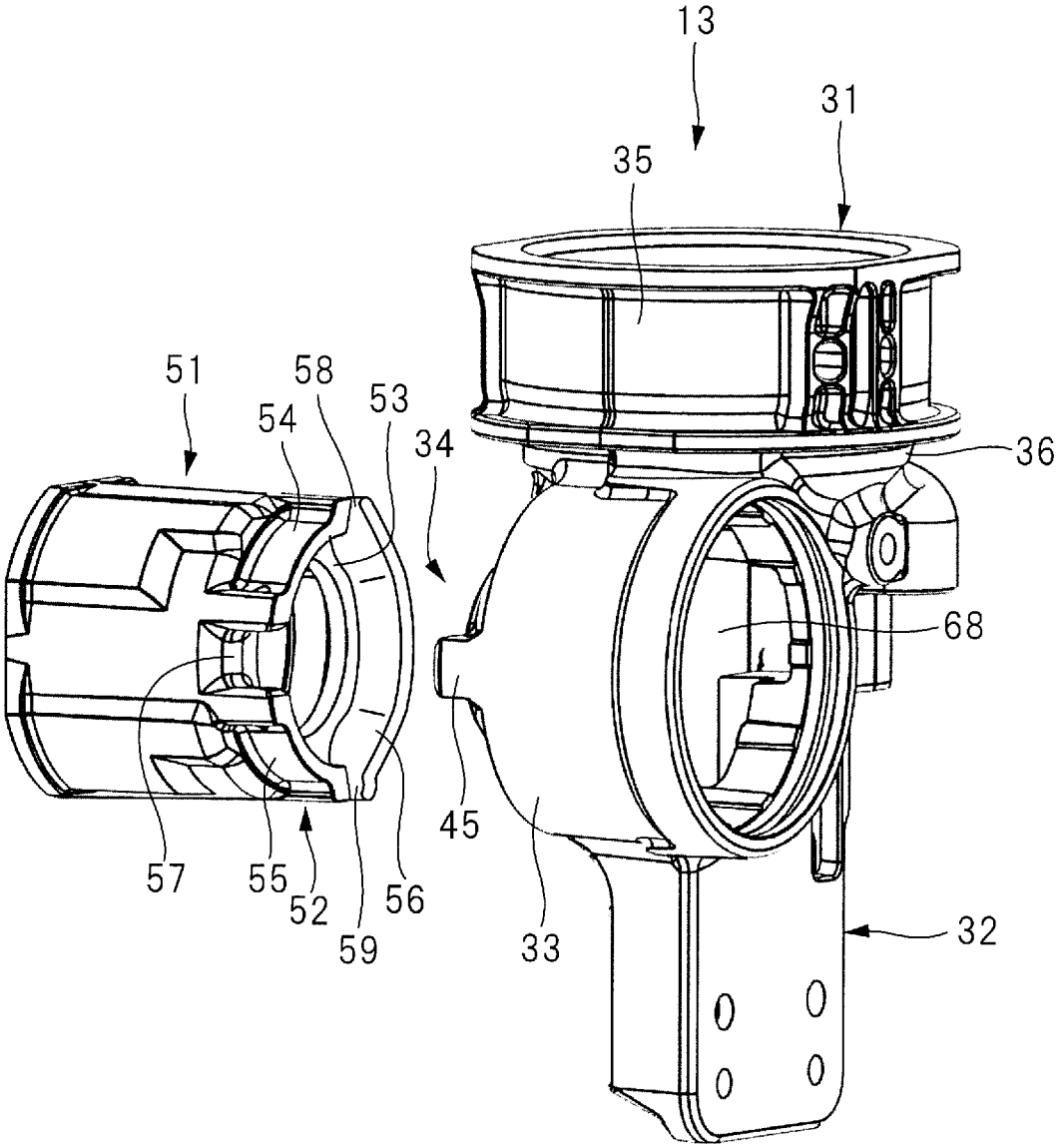
FIG. 12 is an exploded perspective view showing a nose section and a gear case of the driver.
Figure 13:
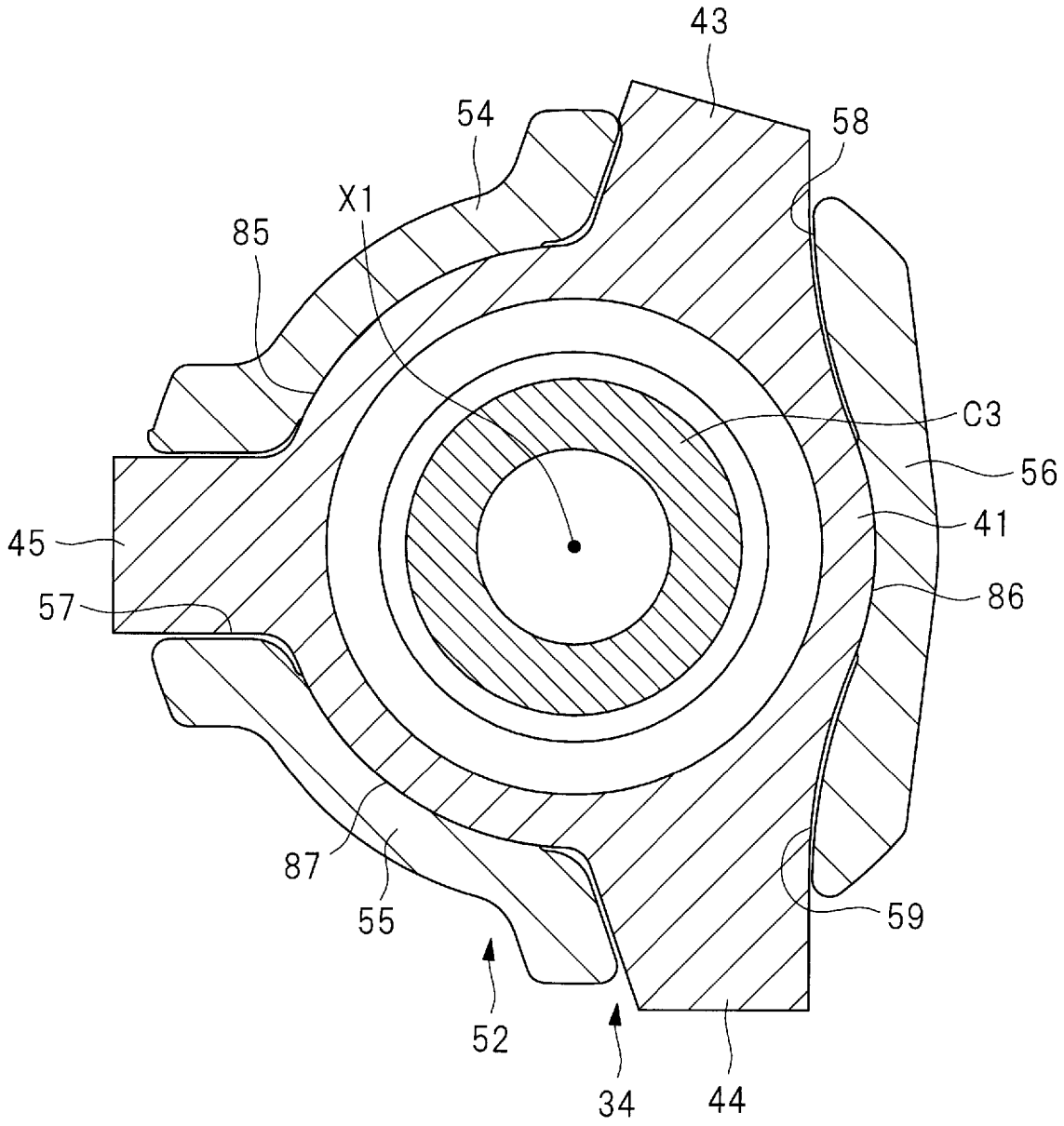
FIG. 13 is a cross-sectional view showing another specific example of the first coupling section and the second coupling section included in the driver.
Figure 14:
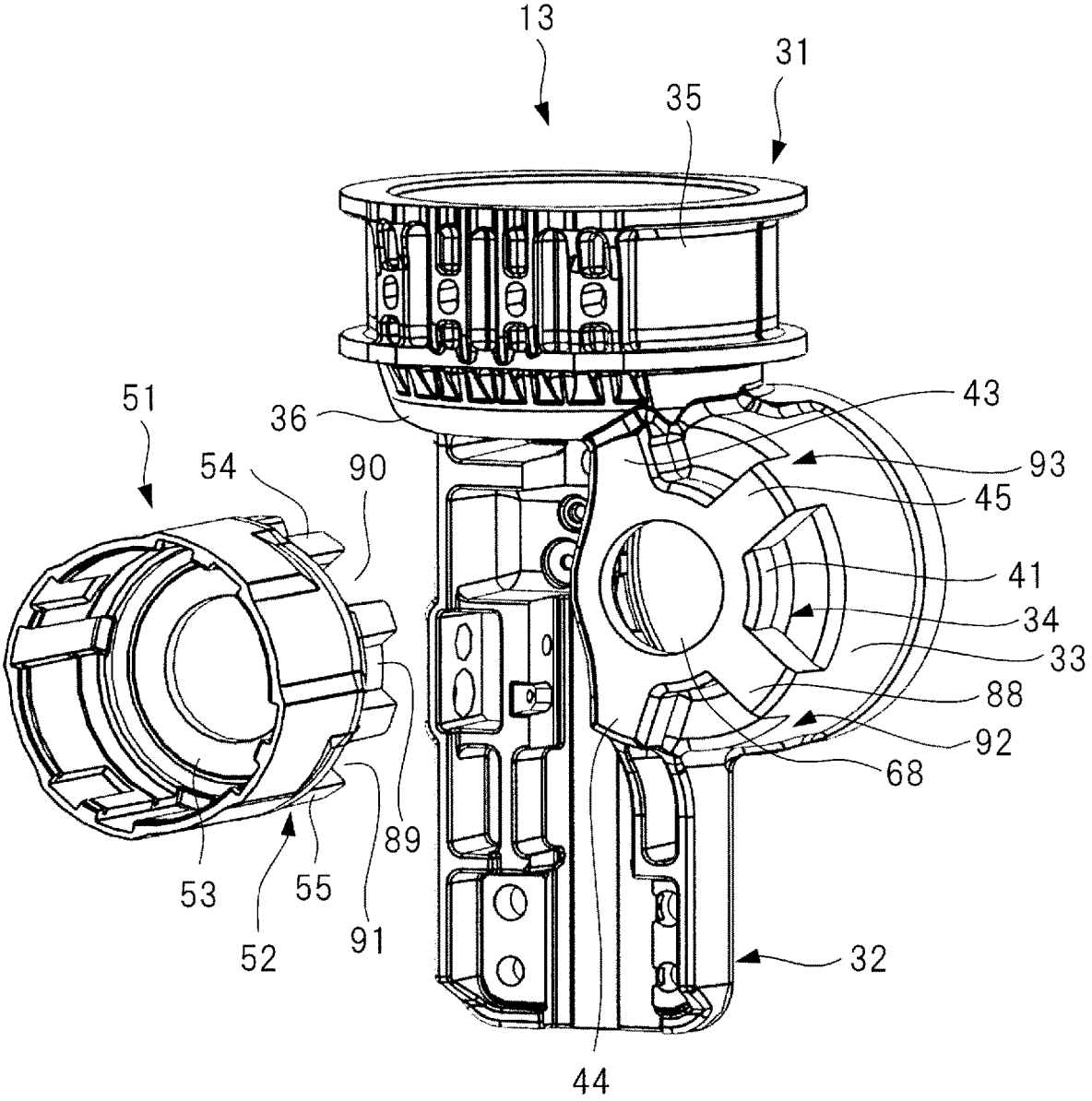
FIG. 14 is an exploded perspective view showing a nose section and a gear case of the driver.
Figure 15:
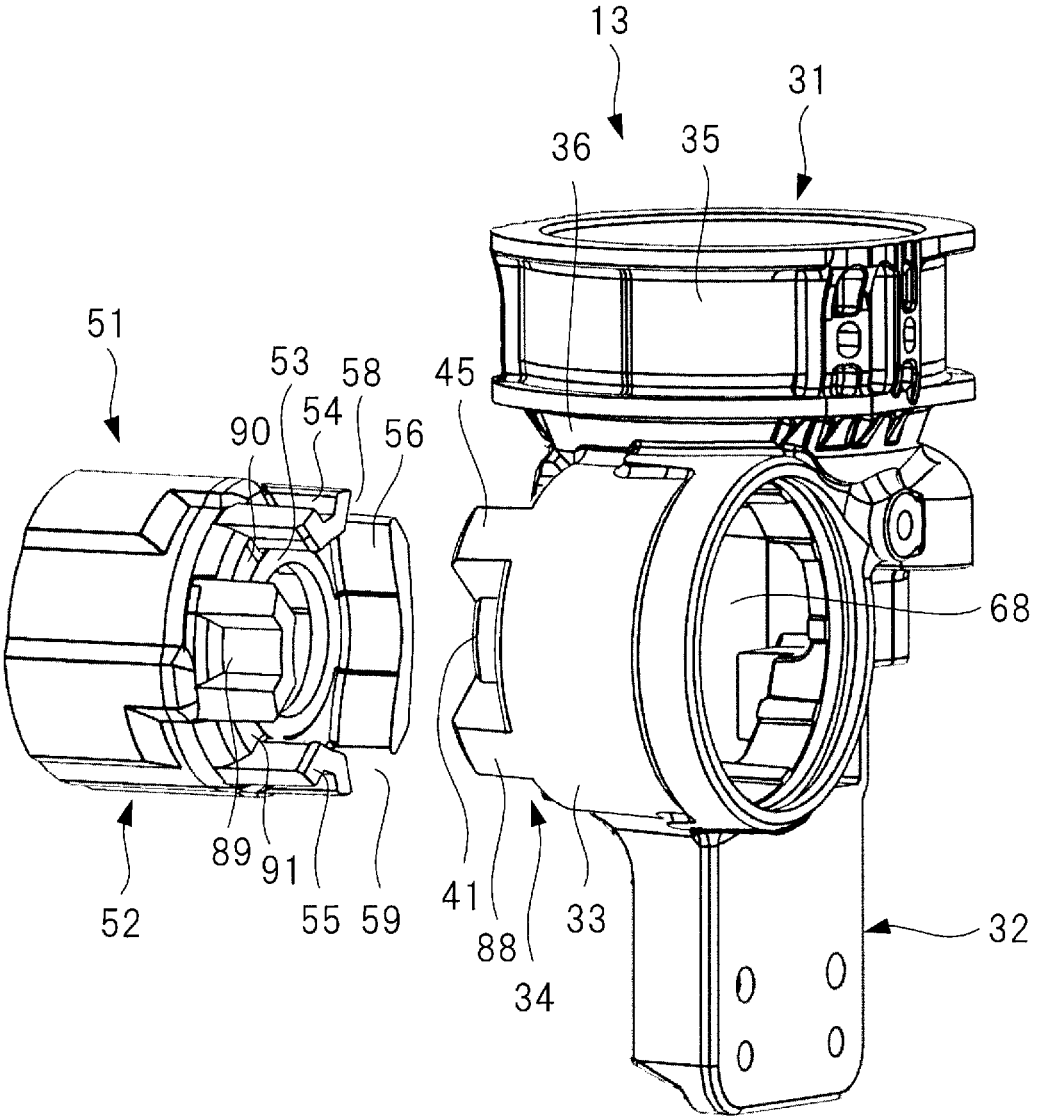
FIG. 15 is an exploded perspective view showing a nose section and a gear case of the driver.

Therefore, the nose section 13 shown in FIGS. 14 and 15 can suppress the occurrence of stress concentration at the position connecting the bumper support section 31 to the injection section 32 as in the case of the nose section 13 shown in FIGS. 11 and 12. In addition, in the nose section 13 shown in FIG. 14 and FIG. 15, the same effects can be obtained with the same components as those in FIG. 11 and FIG. 12.

Figure 16:
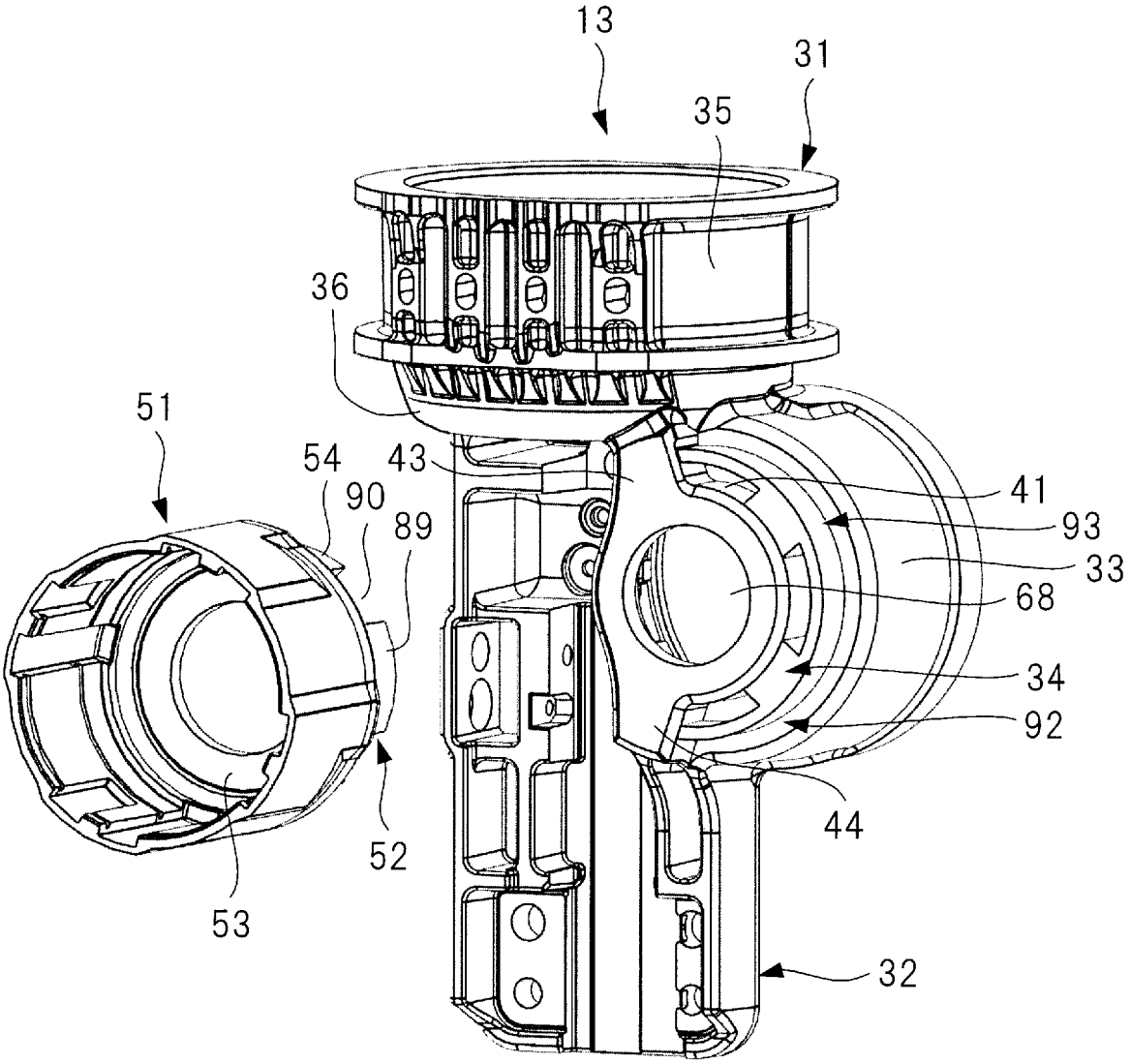
FIG. 16 is an exploded perspective view showing a nose section and a gear case of the driver.
Figure 17:
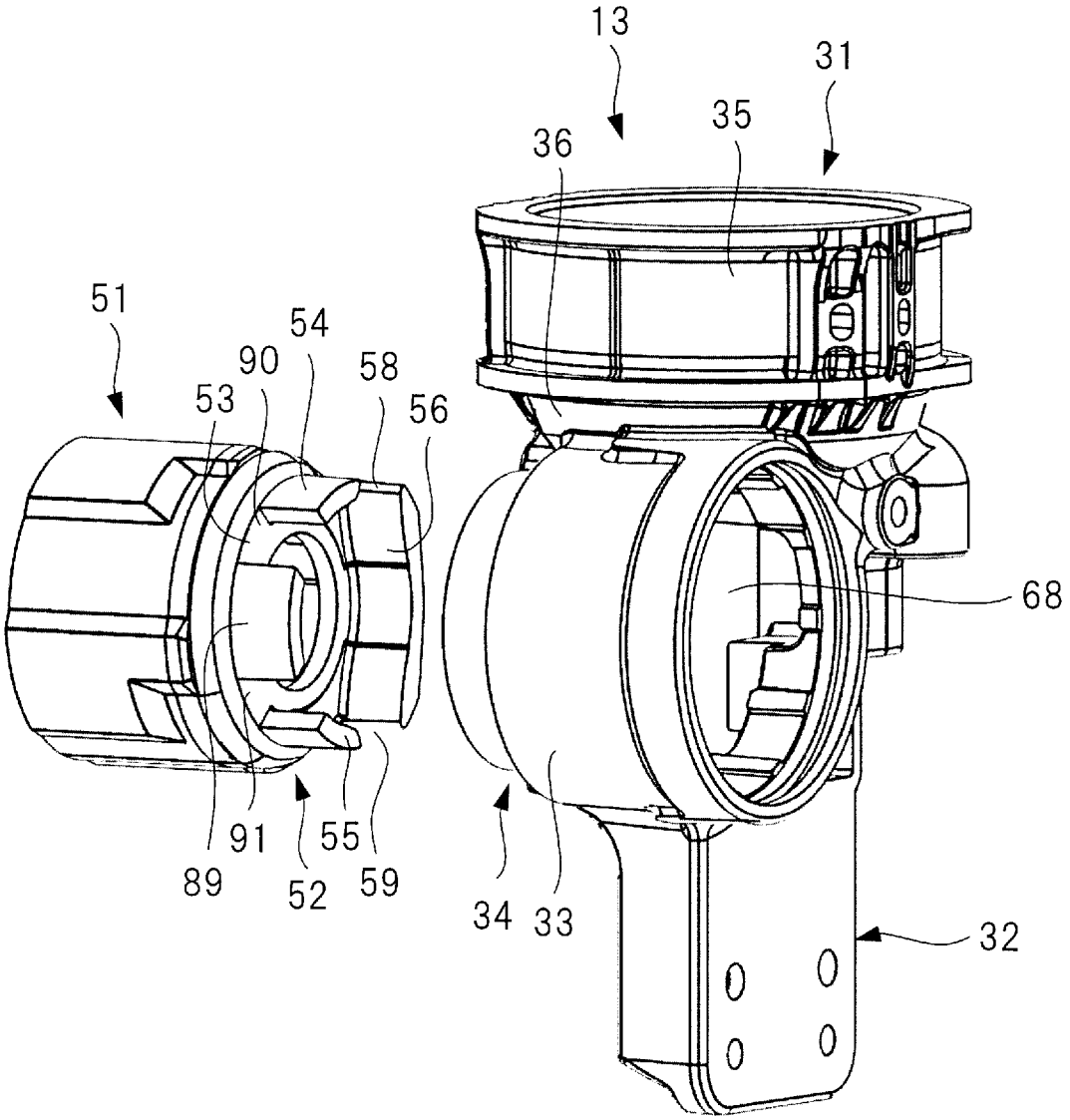
FIG. 17 is an exploded perspective view showing a nose section and a gear case of the driver.

Another specific example of the first coupling section 34 and the second coupling section 52 shown in FIGS. 14 and 15 will be described with reference to FIGS. 16 and 17. The components in FIGS. 16 and 17 which are the same as those in FIGS. 14 and 15 are denoted by the same reference numerals as in FIGS. 14 and 15. The first coupling section 34 shown in FIG. 16 has the first protrusion 43 and the second protrusion 44, but does not include the third protrusion 45 and the fourth protrusion 88. In the first coupling section 34 shown in FIG. 16, the first protrusion 43 and the second protrusion 44 receive the load in the first direction D1 in FIG. 1, and the first protrusion 43 and the second protrusion 44 receive the torsional load. Other effects of the first coupling section 34 and the second coupling section 52 in FIGS. 16 and 17 are the same as other effects of the first coupling section 34 and the second coupling section 52 in FIGS. 14 and 15.

Another specific example of the first coupling section 34 and the second coupling section 52 shown in FIGS. 6, 7 and 8 will be described with reference to FIG. 18. An elastic body 95 is attached to the first arc section 54, and an elastic body 96 is attached to the second arc section 55. The elastic bodies 95 and 96 are made of, for example, synthetic rubber or silicone rubber. The elastic body 95 is formed in an annular shape surrounding the entire circumference of the first arc section 54, and the elastic body 96 is formed in an annular shape surrounding the entire circumference of the second arc section 55.

The elastic body 95 is interposed between the first arc section 54 and the first protrusion 43, between the first arc section 54 and the third protrusion 45, and between the first arc section 54 and the boss section 41. The elastic body 95 has portions 97 and 98. The portion 97 is positioned between the first arc section 54 and the first protrusion 43. The portion 98 is positioned between the first arc section 54 and the third protrusion 45. A thickness t1 of the portion 97 is larger than a thickness t2 of the portion 98. The thicknesses t1 and t2 are dimensions in the circumferential direction of the gear case 51.

The elastic body 96 is interposed between the second arc section 55 and the second protrusion 44, between the second arc section 55 and the third protrusion 45, and between the second arc section 55 and the boss section 41. The elastic body 96 has portions 99 and 100. The portion 99 is positioned between the second arc section 55 and the third protrusion 45. The portion 100 is positioned between the second arc section 55 and the second protrusion 44. A thickness t1 of the portion 99 is larger than a thickness t2 of the portion 100. The elastic body 95 is fitted into the first arc section 54 or is fixed to the first arc section 54 with an adhesive. The elastic body 96 is fitted into the second arc section 55 or is fixed to the second arc section 55 with an adhesive.

Figure 18:
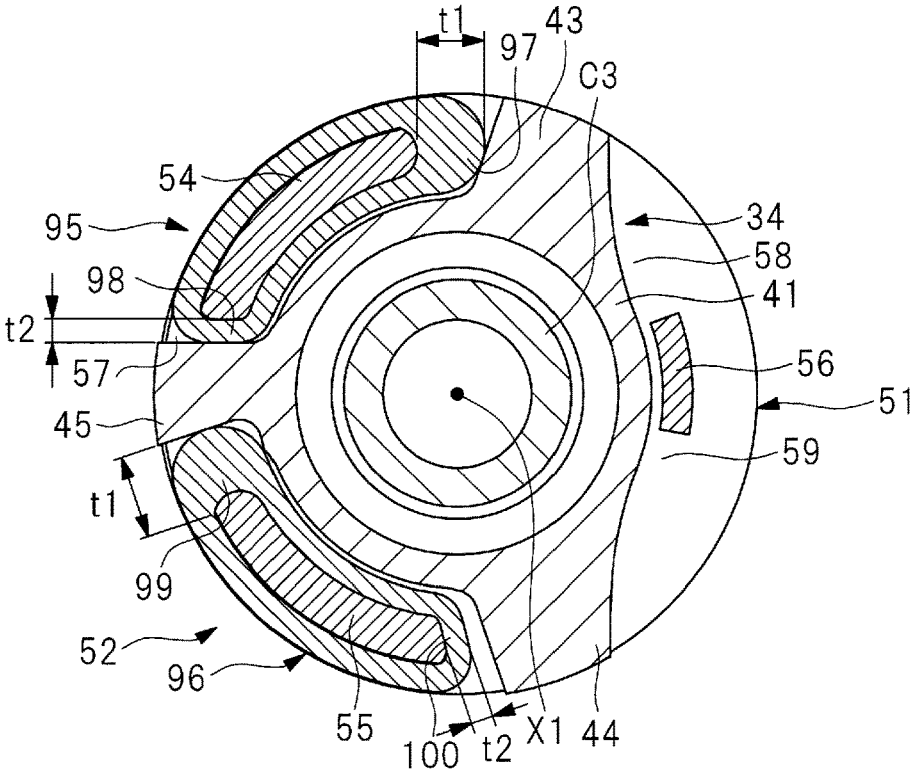
FIG. 18 is a cross-sectional view showing another specific example of the first coupling section and the second coupling section included in the driver.

When the piston 27 in FIG. 5 hits the bumper 38, the first coupling section 34 and the second coupling section 52 shown in FIG. 18 can obtain the same effects as those of first coupling section 34 and the second coupling section 52 shown in FIGS. 6, 7 and 8. In particular, when the gear case 51 is displaced in the circumferential direction relative to the first coupling section 34, the load is transmitted to the first coupling section 34 via the elastic bodies 95 and 96. Therefore, the load in the circumferential direction that the first coupling section 34 receives about the first center line X1 can be reduced, and the life span of the nose section 13 is improved.

Further, a part of the elastic body 95 is interposed between the boss section 41 and the first arc section 54, and a part of the elastic body 96 is interposed between the boss section 41 and the second arc section 55. Therefore, even when the gear case 51 is displaced in the direction of the second center line X2 relative to the first coupling section 34, the elastic deformation of the elastic bodies 95 and 96 can reduce the load received by the first coupling section 34.

The other functions of the elastic bodies 95 and 96 will be described. When transmitting the rotational force of the electric motor 15 to the pin wheel 69 to raise the strike section 12, the first ring gear R1, the second ring gear R2 and the third ring gear R3 function as reaction force elements. For this reason, the gear case 51 receives a clockwise rotational force in FIG. 18. Further, when the rotational force of the electric motor 15 is transmitted to the pin wheel 69 while the nail 80 is stuck in the injection passage 40, the strike section 12 does not go up. For this reason, the torque that the gear case 51 receives via the first ring gear R1, the second ring gear R2 and the third ring gear R3 which are the reaction force elements, that is, the clockwise rotational force that the gear case 51 receives in FIG. 18 is increased.

Further, when the rotational force of the electric motor 15 is transmitted to the pin wheel 69 while the nail 80 is stuck in the injection passage 40, the driver blade 28 shown in FIG. 10 goes up. In addition, a phenomenon in which any one of the protruding portions 71 comes out from any one of the pinion pins 70 and the driver blade 28 goes down, and any one of the protruding portions 71 hits any one of the pinion pins 70, may be generated. Moreover, when manufacturing the driver 10 or repairing the driver 10, a phenomenon in which the protruding portions 71 hit the pinion pins 70 may occur. In this case, the pin wheel 69 receives a clockwise rotational force in FIG. 10. Then, the rotational force received by the rotation restricting mechanism 76 is transmitted to the gear case 51, so that the clockwise rotational force received by the gear case 51 in FIG. 18 is increased.

Thus, when the piston 27 is separated from the bumper 38, the clockwise rotational force that the gear case 51 receives in FIG. 18 may increase. In the present embodiment, the elastic body 95 is attached to the first arc section 54, and the elastic body 96 is attached to the second arc section 55. For this reason, when the clockwise rotational force acting on the gear case 51 in FIG. 18 increases, the elastic body 95 elastically deforms between the first arc section 54 and the first protrusion 43, and the elastic body 96 elastically deforms between the second arc section 55 and the third protrusion 45. Therefore, the peak value of the load received by the nose section 13 can be reduced, and the durability of the nose section 13 is improved.

Furthermore, when the clockwise rotational force acts on the gear case 51 in FIG. 18, the portion 97 is sandwiched between the first arc section 54 and the first protrusion 43, and the portion 99 is sandwiched between the second arc section 55 and the third protrusion 45. The thickness t1 of the portions 97 and 99 is larger than the thickness t2 of the portions 98 and 100. Therefore, the load received by the first coupling section 34 can be effectively reduced.

Another specific example of the first coupling section 34 and the second coupling section 52 shown in FIGS. 6, 7 and 8 will be described with reference to FIG. 19. An elastic body 108 is attached to the third arc section 56. The elastic body 108 is made of, for example, synthetic rubber or silicone rubber. The elastic body 108 is annular and surrounds the entire circumference of the third arc section 56. The elastic body 108 is fitted to the third arc section 56 or is fixed to the third arc section 56 with an adhesive. The other constituents shown in FIG. 19 is the same as the other constituents shown in FIG. 18.

Figure 19:
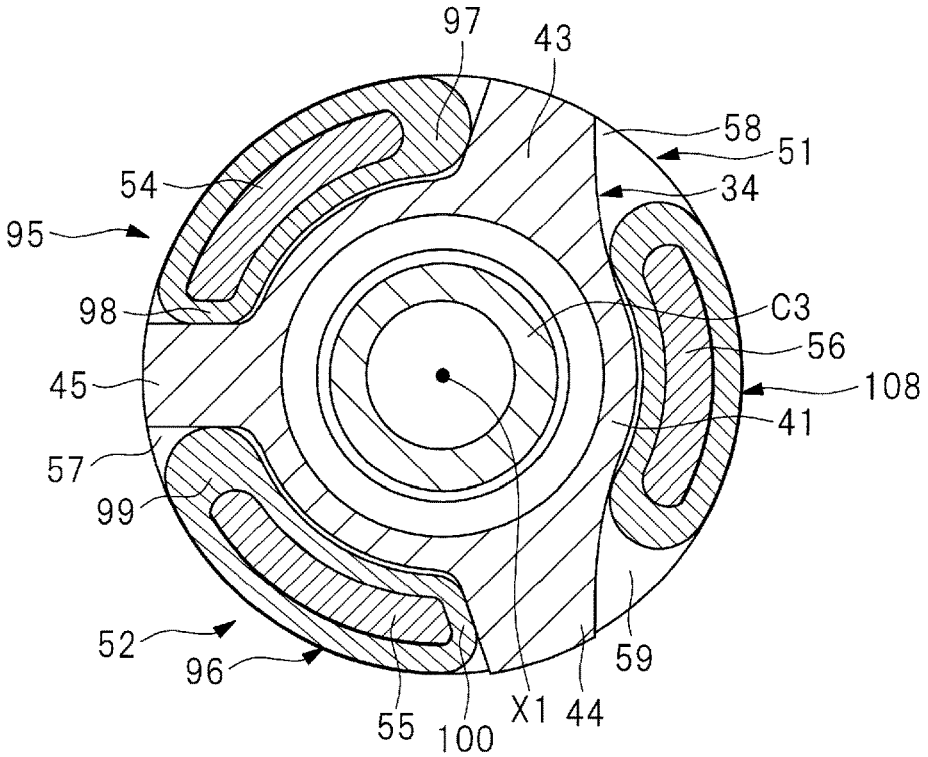
FIG. 19 is a cross-sectional view showing another specific example of the first coupling section and the second coupling section included in the driver.

In both of the case where the piston 27 in FIG. 5 hits the bumper 38 and the case where the piston 27 is separated away from the bumper 38, the first coupling section 34 and the second coupling section 52 shown in FIG. 19 can obtain the same effects as those in the first coupling section 34 and the second coupling section 52 shown in FIGS. 6, 7 and 8.

In addition, the elastic body 108 is attached to the third arc section 56. For this reason, when the piston 27 is separated away from the bumper 38 and the clockwise rotational force received by the gear case in FIG. 19 is increased, the elastic body 108 is elastically deformed. Therefore, the peak value of the load received by the nose section 13 can be reduced, and the durability of the nose section 13 is improved.

Another specific example of the first coupling section 34 and the second coupling section 52 shown in FIGS. 6, 7 and 8 will be described with reference to FIG. 20. An elastic body 102 is provided between the first arc section 54 and the first protrusion 43, and an elastic body 103 is provided between the first arc section 54 and the third protrusion 45. An elastic body 104 is provided between the second arc section 55 and the second protrusion 44, and an elastic body 105 is provided between the second arc section 55 and the third protrusion 45. An elastic body 106 is provided between the third arc section 56 and the first protrusion 43, and an elastic body 107 is provided between the third arc section 56 and the second protrusion 44. The elastic body 102 to the elastic body 107 are made of, for example, synthetic rubber or silicone rubber.

Further, the elastic body 102 is provided not to come out from between the first arc section 54 and the first protrusion 43. The elastic body 103 is provided not to come out from between the first arc section 54 and the third protrusion 45. The elastic body 104 is provided not to come out from between the second arc section 55 and the second protrusion 44. The elastic body 105 is provided not to come out from between the second arc section 55 and the third protrusion 45. The elastic body 106 is provided not to come out from between the third arc section 56 and the first protrusion 43.

The elastic body 107 is provided not to come out from between the third arc section 56 and the second protrusion 44.

Figure 20:
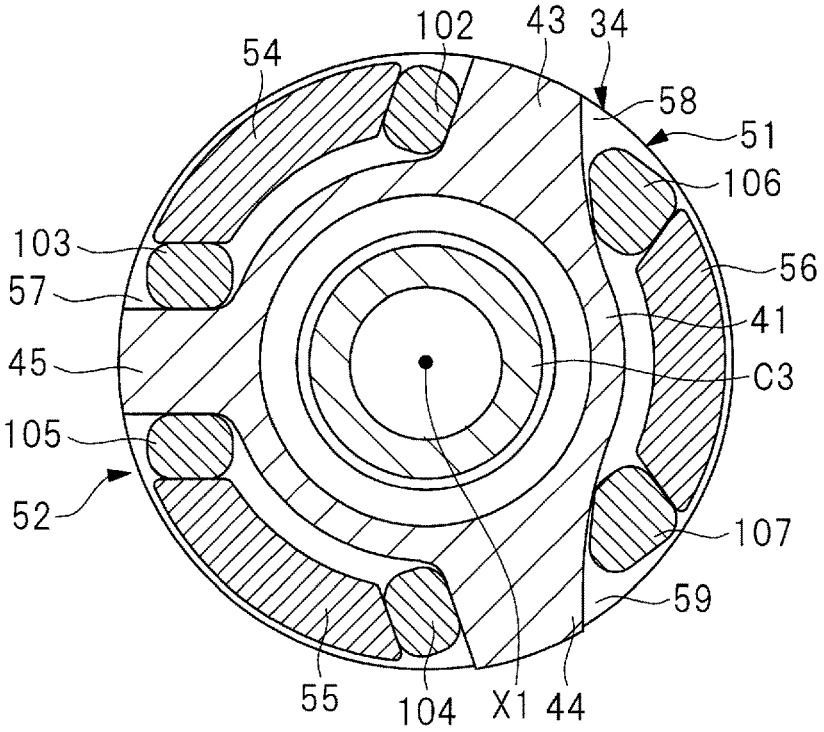
FIG. 20 is a cross-sectional view showing another specific example of the first coupling section and the second coupling section included in the driver.

When the piston 27 of FIG. 5 hits the bumper 38, the first coupling section 34 and the second coupling section 52 shown in FIG. 20 can obtain the same effects as those of the first coupling section 34 and the second coupling section 52 shown in FIGS. 6, 7 and 8. In particular, when the gear case 51 is displaced in the circumferential direction relative to the first coupling section 34, the load is transmitted to the first coupling section 34 via the elastic bodies 102 to 107. Therefore, the load in the circumferential direction that the first coupling section 34 receives about the first center line X1 can be reduced, and the life span of the nose section 13 is improved.

Also, when the clockwise rotational force received by the gear case 51 in FIG. 19 is increased while the piston 27 is separated away from the bumper 38 as shown in FIG. 5, the elastic body 102 is sandwiched between the first arc section 54 and the first protrusion 43 to be elastically deformed. In addition, the elastic body 105 is elastically deformed by being sandwiched between the second arc section 55 and the third protrusion 45. Further, the elastic body 107 is elastically deformed by being sandwiched between the third arc section 56 and the second protrusion 44. Therefore, the peak value of the load received by the nose section 13 can be reduced, and the durability of the nose section 13 is improved.

Another specific example of the first coupling section 34 and the second coupling section 52 shown in FIGS. 6, 7 and 8 will be described with reference to FIG. 21. In the configuration shown in FIG. 21, the same components as those in FIG. 20 are denoted by the same reference numerals as those in FIG. 20. In the configuration shown in FIG. 21, the elastic body 102 is provided between the first protrusion 43 and the first arc section 54, and the elastic body 105 is provided between the third protrusion 45 and the second arc section 55.

A recessed portion 109 is provided in a portion near the first arc section 54 in the first protrusion 43, and a recessed portion 110 is provided in a portion near the second arc section 55 in the third protrusion 45. The recessed portions 109 and 110 are recessed in the circumferential direction around the first center line X1.

Figure 21:
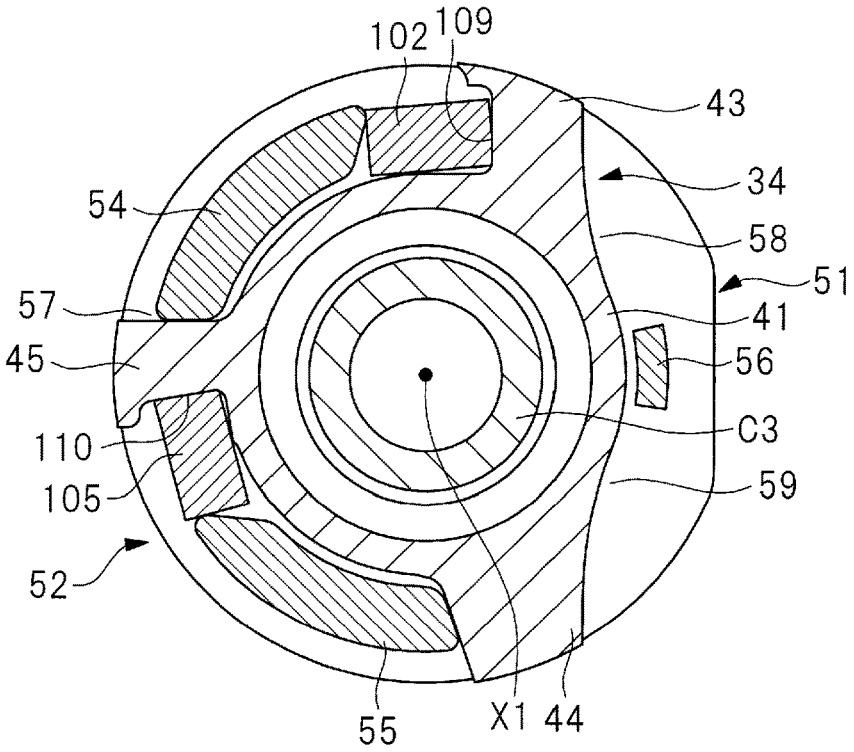
FIG. 21 is a cross-sectional view showing another specific example of the first coupling section and the second coupling section included in the driver.

When a clockwise rotational force acts on the gear case 51 in FIG. 21, the elastic body 102 is sandwiched between the first protrusion 43 and the first arc section 54 to be elastically deformed, and the elastic body 105 is sandwiched between the third protrusion 45 and the second arc section 55 to be elastically deformed. Therefore, the peak value of the load received by the nose section 13 can be reduced, and the durability of the nose section 13 is improved.

Also, since the recessed portion 109 is provided, when the elastic body 102 is elastically deformed and expanded in the radial direction, it is possible to inhibit a portion of the elastic body 102 from being extruded from between the first arc section 54 and the first protrusion 43 in the radial direction of the gear case 51, and it is possible to inhibit the durability of the elastic body 102 from being reduced. In addition, since the recessed portion 110 is provided, when the elastic body 105 is elastically deformed and expanded in the radial direction, it is possible to inhibit a portion of the elastic body 105 from being extruded from between the second arc section 55 and the third protrusion 45 in the radial direction of the gear case 51, and it is possible to inhibit the durability of the elastic body 105 from being reduced. Other effects in FIG. 21 are the same as other effects in FIG. 20.

Another specific example of the first coupling section 34 and the second coupling section 52 shown in FIGS. 6, 7 and 8 will be described with reference to FIG. 22. In the configuration shown in FIG. 22, the same components as those in FIG. 21 are denoted by the same reference numerals as those in FIG. 21. In the configuration shown in FIG. 22, a frame 111 is provided outside the second coupling section 52 in the radial direction of the gear case 51. The frame 111 is fixedly provided in the housing 11. The frame 111 is disposed in an arc shape around the first center line X1. Specifically, it is provided between the first protrusion 43 and the second protrusion 44 in a range of 180 degrees including the third protrusion 45.

Figure 22:
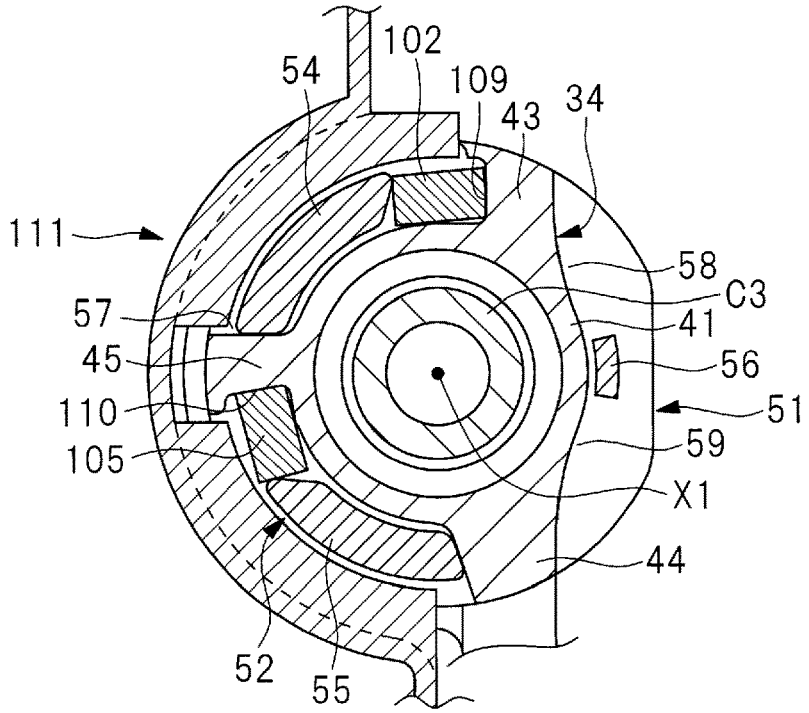
FIG. 22 is a cross-sectional view showing another specific example of the first coupling section and the second coupling section included in the driver.
Figure 23:
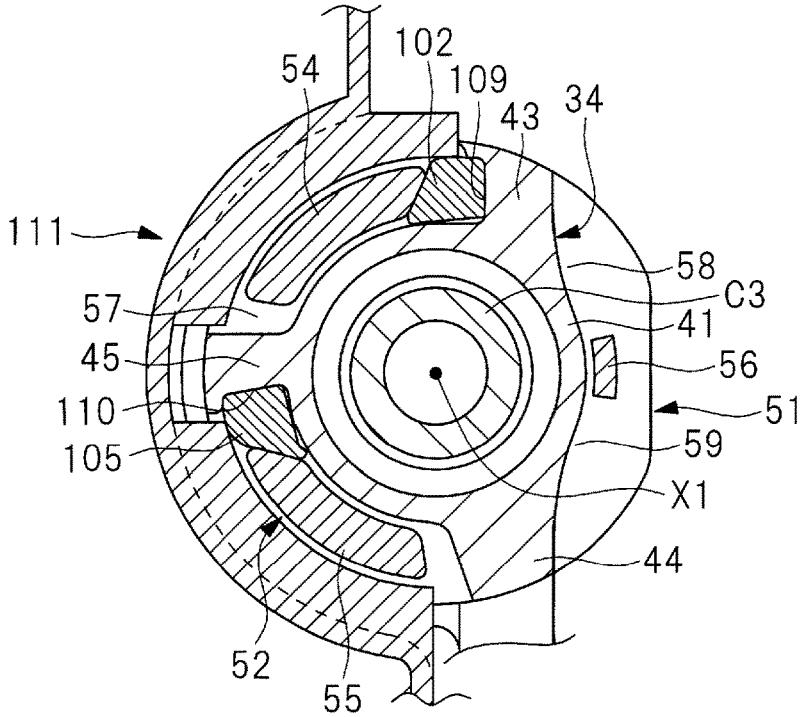
FIG. 23 is a cross-sectional view showing a state in which an elastic body is elastically deformed in the specific example shown in FIG. 22.

In the configuration shown in FIG. 22, when a clockwise rotational force acts on the gear case 51, the elastic bodies 102 and 105 are elastically deformed as shown in FIG. 23 due to the same action as that of FIG. 21 so that the same effect as that of the configuration in FIG. 21 can be obtained. Also, when the elastic bodies 102 and 105 are elastically deformed in the configuration shown in FIG. 22, the frame 111 comes into contact with the elastic bodies 102 and 105 as shown in FIG. 23. Therefore, the frame 111 inhibits the elastic bodies 102 and 105 from expanding outward in the radial direction of the gear case 51. That is, the frame 111 can inhibit the elastic body 102 from coming out between the first protrusion 43 and the first arc section 54 and the elastic body 105 from coming out between the third protrusion 45 and the second arc section 55.

The meanings of the items described in the driver according to one embodiment are as follows. The first direction D1 is an example of a first direction, and the second direction D2 is an example of a second direction. The strike section 12 is an example of a strike section, the bumper 38 is an example of a bumper, and the driver 10 is an example of a driver. The nail 80 is an example of a fastener, the nose section 13 is an example of a support section, and the gear case 51 and the motor case 20 are an example of a connection section. The speed reduction mechanism 16 and the electric motor 15 are an example of a drive section.

The boss section 41, the first protrusion 43, the second protrusion 44, and the sleeve 42 are an example of a first receiving section 92 and a second auxiliary extension section, and the first protrusion 43, the second protrusion 44, the third protrusion 45, and the fourth protrusion 88 are an example of a second receiving section 93. The first protrusion 43 is an example of a second extension section, and the second protrusion 44 is an example of a first extension section. The third protrusion 45 is an example of a first auxiliary extension section. The first protrusion 43, the second protrusion 44, and the third protrusion 45 are an example of a rotation restricting extension section. The rotation restricting extension section is a mechanism that restricts the connection section from rotating relative to the support section. That is, any one of the first protrusion 43, the second protrusion 44, and the third protrusion 45, which is an example of the rotation restricting extension section, also serves as any one of the first extension section, the second extension section, and the first auxiliary extension section. The first coupling section 34 is an example of a first coupling section, the second coupling section 52 is an example of a second coupling section, and the pressure chamber 25 is an example of an urging section. The first center line X1 is an example of a first center line, and the second center line X2 is an example of a second center line. The electric motor 15 is an example of a motor, and the conversion mechanism 17 is an example of a transmission mechanism.

The protruding portion 71 is an example of a first engaging portion, the pin wheel 69 is an example of a rotating element, and the pinion pin 70 is an example of a second engaging portion. The piston 27 is an example of a piston, and the driver blade 28 is an example of a driver blade. The cylinder 26 is an example of a cylinder, the cylinder case 18 is an example of a first case, and the motor case 20 is an example of a second case. The handle 19 is an example of a handle, the mounting section 94 is an example of a mounting section, and the power supply section 14 is an example of a power supply section. The frame 111 is an example of a retainer.

The driver is not limited to the above embodiment, and various modifications can be made without departing from the scope of the present invention. For example, the pressure chamber may be formed inside the bellows. The strike section includes a structure in which the piston and the driver blade are provided as separate members and the piston and the driver blade are fixed to each other. The strike section includes a structure in which the piston and the driver blade are integrated into a single member.

The urging section includes a mechanism which moves the strike section with the force of an elastic member, in addition to the pressure chamber filled with the gas. The elastic member includes a compression spring made of a synthetic rubber or a metal. The conversion mechanism includes a rack and pinion mechanism, a cam mechanism, and a traction mechanism. The cam mechanism has a cam plate that is rotated by the rotational force of a motor, a cam surface provided on the cam plate, and a slider that moves along the cam surface and is attached to the driver blade. The traction mechanism has a rotating element which is rotated by the rotational force of a motor, and a cable which is wound around the rotating element and pulls a piston.

The motor as a power source for moving the strike section includes an engine, a hydraulic motor, and a pneumatic motor in addition to the electric motor. The electric motor may be either a brushed motor or a brushless motor. The standby position of the strike section may be either the position where the piston is away from the bumper or the position where the piston is in contact with the bumper. The fastener includes a rod-shaped needle and a U-shaped metal piece in addition to a rod-shaped nail. The elastic body provided between the rotation restricting extension section and the connection section is a buffer member that receives a load to be elastically deformed.

The driver includes a first structure and a second structure. In the first structure, as shown in FIGS. 1 and 5, the nose section and the cylinder case are formed as separate members. In the first structure, the gear case and the motor case are formed as separate members, and the motor case supports the gear case via the partition wall.

In the second structure, the nose section and the cylinder case are integrated, and the gear case is integrated with the motor case. Also, the cylinder case and the motor case are formed as separate members. In the second structure, the cylinder case is an example of a support section, and the motor case is an example of a connection section. Further, the cylinder case has a first coupling section, and the motor case has a second coupling section.

In the driver according to the embodiment, the first coupling section includes the first to third protrusions, and the second coupling section has the first to third arc sections and first to third notches. On the other hand, the second coupling section may have the first to third protrusions, and the first coupling section may have the first to the third arc sections and the first to third notches.

The driver of the embodiment may include the first receiving section and the second receiving section. The first protrusion and the sleeve are an example of a first receiving section, and the first protrusion and the second protrusion are an example of a second receiving section. For this reason, the third protrusion may not be provided.

The power supply section supplies power to the electric motor. The power supply includes a direct current power supply and an alternating current power supply. The direct current power supply includes a primary battery and a secondary battery. The power supply section includes an adapter connected to the direct current power supply or the alternating current power supply via a power cable.

The following items are also described in the present embodiments.

The first item is that the urging section is provided to move the strike section in the first direction, and the drive section moves the strike section in the second direction against the force of the urging section.

The second item is that the drive section has the motor rotatable around the first center line, and the conversion mechanism is provided to convert the rotational force of the motor into the moving force of the strike section in the first direction.

The third item is that the conversion mechanism has the first engaging portion provided in the strike section, the rotating element which is rotated due to the transmission of the rotational force of the motor, and the second engaging portion which is provided in the rotating element and is capable of engaging and disengaging with the first engaging portion, and the first center line and the second center line when the strike section moves in the first direction are disposed with an interval when viewed in a plan view intersecting the first center line.

The fourth item is that the drive section has the speed reduction mechanism disposed in the power transmission path between the motor and the rotating element, and the speed reduction mechanism makes the rotational speed of the rotating element slower than the rotational speed of the motor.

The invention claimed is:

1. A driver comprising:

a strike section which moves in a first direction to strike a fastener; and a bumper which comes into contact with the strike section and restricts the range in which the strike section moves in the first direction, the driver further comprising:

a support section which supports the bumper;

a connection section which is connected to the support section and is disposed in a direction intersecting the first direction;

a drive section which is supported by the connection section and moves the strike section in a second direction, a first receiving section which receives a load acting on the support section in the first direction when the strike section moves in the first direction to hit the bumper, and a second receiving section which receives a load acting on the support section in a circumferential direction about a first centerline of the drive section when the strike section moves in the first direction to hit the bumper, the support section includes a first coupling section formed having an opening which the drive section passes through in a direction of the first centerline, the connection section is formed in a cylindrical shape with respect to the first centerline, and includes a second coupling section which the drive section passes through an inside of the second coupling section, the first coupling section and the second coupling section are coupled in the direction of the first centerline, the first receiving section and the second receiving section are provided at a location in which the first coupling section and the second coupling section are coupled, the first receiving section has a first extension section directed outward in a radial direction, the second receiving section has a rotation restricting extension section directed outward in the radial direction.

2. The driver according to claim 1, wherein the first receiving section and the second receiving section are provided in the support section.

3. The driver according to claim 1, wherein the first receiving section has a first extension section extending in the first direction in the support section, and a second extension section extending in the second direction in the support section.

4. The driver according to claim 3, wherein an elastic body is provided between the rotation restricting extension section and the connection section.

5. The driver according to claim 4, wherein the elastic body is fixed to the connection section.

6. The driver according to claim 4, wherein a retainer is provided to suppress the elastic body from coming out from between the rotation restricting extension section and the connection section.

7. The driver according to claim 1, wherein the first receiving section has an second auxiliary extension section extending in the direction of the first center line of the support section.

8. The driver according claim 1, wherein the strike section has a piston that is movable in the first direction and the second direction, and a driver blade connected to the piston, and the support section supports the bumper which the piston hits when moving in the first direction.

9. The driver according to claim 8, further comprising:

a cylinder movably supporting the strike section in the first direction and the second direction;

a first case that accommodates the support section and the cylinder;

a handle which is connected to the first case;

a mounting section connected to the handle; and a power supply unit provided in the mounting section, wherein the drive section includes an electric motor that is rotatable about the first center line, the power supply section supplies power to the electric motor, the connection section includes a gear case for accommodating a speed reduction mechanism, and a second case for accommodating the electric motor, and the second case is connected to the first case and the mounting section.

10. A driver comprising:

a strike section which moves in a first direction to strike a fastener; and a bumper which comes into contact with the strike section and restricts the range in which the strike section moves in the first direction, the driver further comprising:

a support section which supports the bumper;

a connection section which is connected to the support section and is disposed in a direction intersecting the first direction;

a drive section which is supported by the connection section and moves the strike section in a second direction, the support section includes a first coupling section formed having an opening which the drive section passes through in a direction of the first centerline, the connection section is formed in a cylindrical shape extending in the direction of the first centerline, and includes a second coupling section which the drive section passes through an inside of the second coupling section, the first coupling section and the second coupling section are coupled in the direction of the first centerline, the first coupling section includes a first extension section extending from the opening towards an outside in a radial direction, and a rotation restricting extension section extending from the opening towards the outside in the radial direction.

11. The driver according to claim 10, wherein the first extension section extends from the opening to the first direction, and the first coupling section further includes a second extension section extending from the opening to the second direction.

12. A driver comprising:

a strike section which moves in a first direction to strike a fastener; and a bumper which comes into contact with the strike section and restricts the range in which the strike section moves in the first direction, the driver further comprising:

a support section which supports the bumper;

a connection section which is connected to the support section and is disposed in a direction intersecting the first direction;

a drive section which is supported by the connection section and moves the strike section in a second direction, the support section includes a first coupling section formed having an opening which the drive section passes through in a direction of the first centerline, the connection section is formed in a cylindrical shape extending in the direction of the first centerline, and includes a second coupling section which the drive section passes through an inside of the second coupling section, the first coupling section and the second coupling section are coupled in the direction of the first centerline, the one of the first coupling section and the second coupling section includes a rotation restricting extension section directed outward in a radial direction, in a circumferential direction about a first centerline, an elastic body is provided between the rotation restricting extension section and an other of the first coupling section and the second coupling section.

* * * * *